US005712443A

United States Patent [19]

Canaday et al.

[11] Patent Number: 5,712,443

[45] Date of Patent: Jan. 27, 1998

[54] SHOULDER-LAUNCHED MULTIPLE-PURPOSE ASSAULT WEAPON

[75] Inventors: Michael Canaday, King George; Fred Watson, Jr., Montross, both of Va.

[73] Assignee: The United States of America as represented by the Secretary of the Navy, Washington, D.C.

[21] Appl. No.: 514,575

[22] Filed: Oct. 30, 1995

[51] Int. Cl.[6] ..... F41F 3/04; F41A 19/00

[52] U.S. Cl. ..... 89/127; 89/1.813; 89/1.816; 42/69.03

[58] Field of Search ..... 42/70.01, 70.04, 42/70.05, 70.06, 70.08, 105, 69.02, 69.03, 16; 89/142, 148, 1.813, 1.816, 1.41, 44.01, 198

[56] References Cited

U.S. PATENT DOCUMENTS

| | | | |
|---|---|---|---|
| 2,383,487 | 8/1945 | Johnson, Jr. | 42/70.04 |
| 2,454,790 | 11/1948 | Garrett | 42/69.01 |
| 2,466,714 | 4/1949 | Kroeger et al. . | |
| 2,926,447 | 3/1960 | Scripter | 42/70 |
| 3,389,637 | 6/1968 | Beier et al. . | |
| 3,442,173 | 5/1969 | Muller | 89/127 |
| 3,490,330 | 1/1970 | Walther . | |
| 3,494,249 | 2/1970 | Choate . | |
| 3,821,920 | 7/1974 | Brieger | 89/132 |
| 4,593,602 | 6/1986 | Faix | 89/1.813 |
| 4,679,486 | 7/1987 | Landaas | 89/126 |
| 4,867,039 | 9/1989 | Dobbins | 89/127 |
| 4,895,061 | 1/1990 | Baricos et al. . | |
| 5,251,533 | 10/1993 | Layton | 89/142 |

OTHER PUBLICATIONS

Fundamentals of Small Arms Weapons, U.S. Army Ordnance Center and School, Oct. 1988.

*Primary Examiner*—Michael J. Carone
*Assistant Examiner*—Christopher K. Montgomery
*Attorney, Agent, or Firm*—James B. Bechtel, Esq.

[57] ABSTRACT

A shoulder-launched multiple-purpose assault weapon having a modified spotter rifle with a top-mounted rocket launcher tube is provided. The spotter rifle forms the base structure of the weapon and all weapon controls are located on the spotter rifle. The spotter rifle has several dual-function mechanisms which perform the combined functions of assembly and safing, bolt-locking back and cartridge ejecting, simultaneous adjustment of both open and optical sights, firing, selectively, of both the spotter round and the rocket round. The combination of these dual-firing mechanisms provides a lighter weight, better-balanced and smaller weapon. The reduction in parts count improves reliability and lowers cost. Other improved features include an adjustable spotter rifle barrel used to match the boresight of the rocket tube and an improved locking mechanism. A dual function trigger assembly operated two sears from a single trigger. The primary sear operates a rotating type hammer while the secondary sear operates a plunger-type hammer. The hammers fire, respectively, the spotter rifle and the rocket tube as selected by the gunner.

12 Claims, 31 Drawing Sheets

SHOULDER-LAUNCHED MULTIPLE-PURPOSE ASSAULT WEAPON

ORIGIN OF THE INVENTION

The invention described herein was made in the performance of official duties by an employee of the Department of the Navy and may be manufactured, used, licensed by or for the Government for any governmental purpose without payment of any royalties thereon.

FIELD OF THE INVENTION

The invention is related to the technical field of assault weapons and in particular to shoulder-launched rocket weapons.

BACKGROUND OF THE INVENTION

Shoulder-fired assault weapons are well known in the field. The earlier models stem from anti-armor weapons developed during World War II. Since that time, the weapon has evolved into a multi-purpose assault weapon suitable for a variety of targets. These targets include not only armored vehicles, but fixed structure and other types of vehicles. The challenge has been to provide a weapon with multiple capabilities suitable for both armored vehicles and light weight structures such as aircraft. The weapon should also be effective against heavily reinforced bunker and lighter weight structures. It has not been generally suitable to use a penetrating shaped charged against light weight structure as the round will completely pass through such a structure, typically exploding far beyond the structure. On tests with a helicopter, for example, a penetrating round punches small entry and exit holes and thereafter explodes beyond the target, leaving the helicopter relatively undamaged. Likewise, a non-penetrating high explosive round has little effect on a hardened vehicle or structure.

Typical solutions to these problems have resulted in a variety of warheads in a variety of calibers. Additionally, spotting rounds must be matched to the ballistics of a particular warhead. The current state-of-art weapon comprises a rocket launcher assembly with a spotting rifle attached to the right side of the launcher tube. There are numerous deficiencies with the design. The right-side mounted spotting rifle is difficult to load and particularly to re-load as the entire spotter assembly is located away from the gunner on the opposite side of the rocket launcher. Further, the weapon lacks good balance resulting in unwieldy handling. The sighting of the spotting rifle is time consuming and not adaptable to changes in rounds under combat conditions. Further, the operation of the spotter rifle, cocking the bolt, reloading, clearing jams and other routine operations, typically require an assistant gunner. Finally, the weapon is heavier because of a duplication of firing mechanisms, trigger linkages, hammers, etc., and the weapon has no "clean" side so that it can be placed on the ground. (The current weapon having a scope on the left side and the spotting rifle on the right side. What is needed is a lighter weight weapon adaptable to different round which can be handled by a single gunner, that is operated from the left side. Additionally, dual-function mechanisms to operate both the spotting rifle and rocket are needed to reduce weight and improve reliability.

SUMMARY OF THE INVENTION

Accordingly, it is an object of the invention to provide a shoulder-launched multi-purpose assault weapon having interchangeable rocket tubes.

It is another object of the invention to provide a shoulder-launched multi-purpose assault weapon having an adjustable spotter rifle barrel for boresighting with the rocket tube.

It is yet another object of the invention to provide a shoulder-launched multi-purpose assault weapon having dual-function assemblies for various functions including safing, firing, assembly and disassembly, bolt locking back, cartridge ejecting, and breech locking.

It is a further object of the invention to provide a shoulder-launched multi-purpose assault weapon having a single sight adjusting mechanism which simultaneously adjusts both optical and open sight systems.

It is a still further object of the invention to provide a shoulder-launched multi-purpose assault weapon having all gunner activated mechanisms including firing, reloading, clearing jams, sighting, disassembly, and safing located on the left side of the weapon accessible to the gunner in a firing position.

Accordingly, the invention is a shoulder-launched multi-purpose assault weapon using a spotter rifle as the base weapon and having a rocket launcher mounted on the top side of the rifle. The rifle is configured with a single dual-function trigger mechanism which fires both the spotter rifle and the rocket. A single trigger is connected to a unique dual sear mechanism operating both a rotating hammer and a plunger hammer. A simple assembly and safing pin secures the trigger assembly to the weapon. When the pin is out, the weapon is safe. During assembly, the pin must be inserted and the weapon fully assembled before arming can be accomplished. A bolt lockback and cartridge ejector also serves two purposes. During firing the device ejects spent spotter rounds. When all spotter rounds have been fired, the device is used to lock the bolt open preparatory to reloading.

BRIEF DESCRIPTION OF THE DRAWINGS

The foregoing objects and other advantages of the present invention will be more fully understood from the following detailed description and reference to the appended drawings wherein.

DETAILED DESCRIPTION OF THE INVENTION

Figure 1:
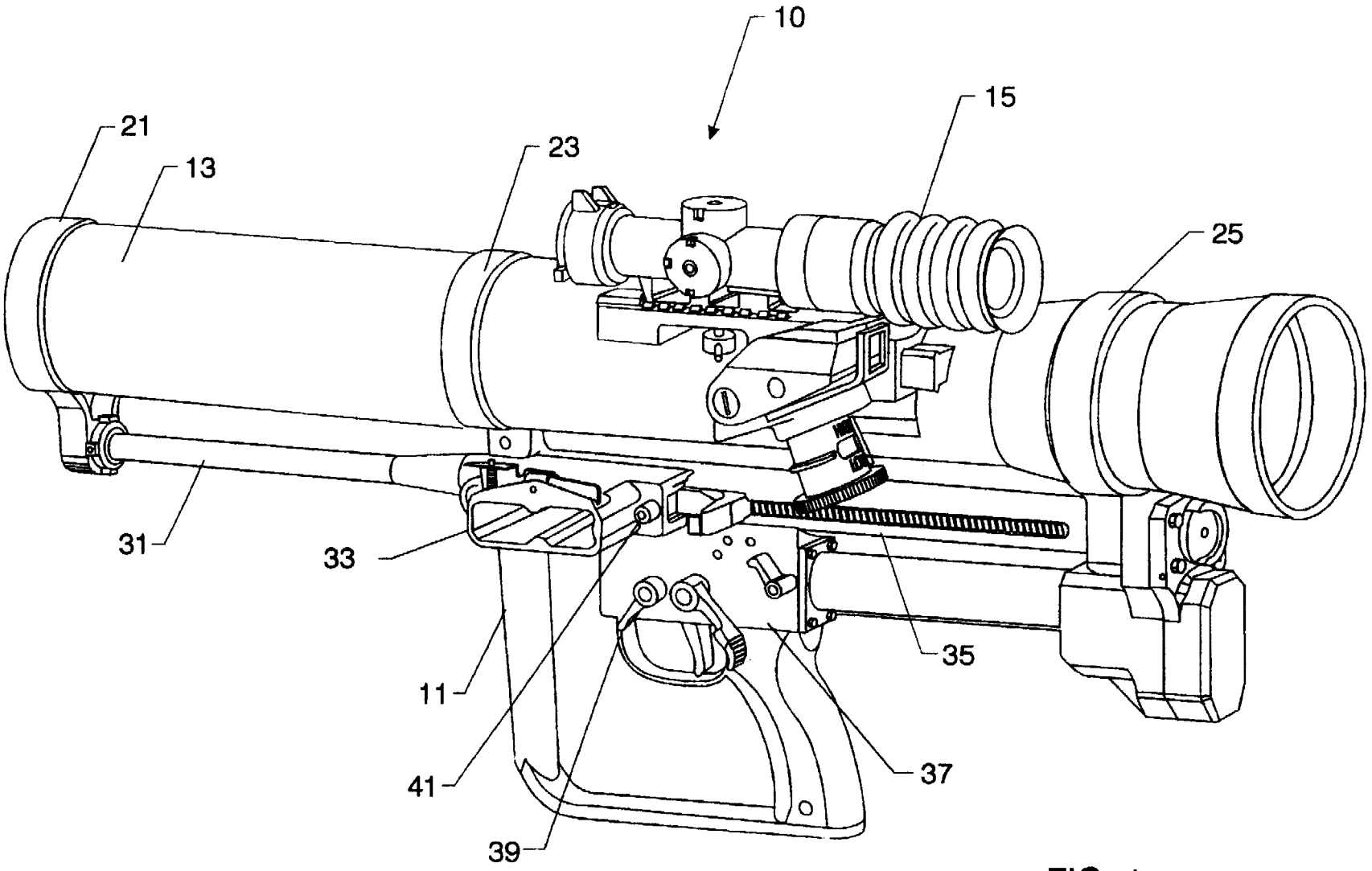
FIG. 1 is a perspective view of the shoulder-fired multi-purpose assault weapon.

Referring now to FIG. 1, the overall shoulder-launched multi-purpose assault weapon, designated generally by the reference numeral 10, is shown with its major components. The weapon assembly uses spotter rifle 11 as the basic building block. Atop the spotter rifle is mounted the rocket launcher tube 13. The combination optical and open sight system 15 is mounted to the rocket launcher tube 13. The rocket launcher tube 13 is held on the spotter rifle 11 by three circular clamps, a forward clamp 21, a center clamp 23, and an aft clamp 25.

The spotter rifle itself comprises an adjustable barrel 31, a magazine receiver 33, a spring-load bolt assembly 35, a combination bolt lockback and cartridge ejector 41, and a trigger assembly 37. One of the major sub-assemblies of the shoulder-launcher multi-purpose assault weapon is the trigger assembly 37 which is secured to the spotter rifle 11 by combination pin 39.

Figure 2:
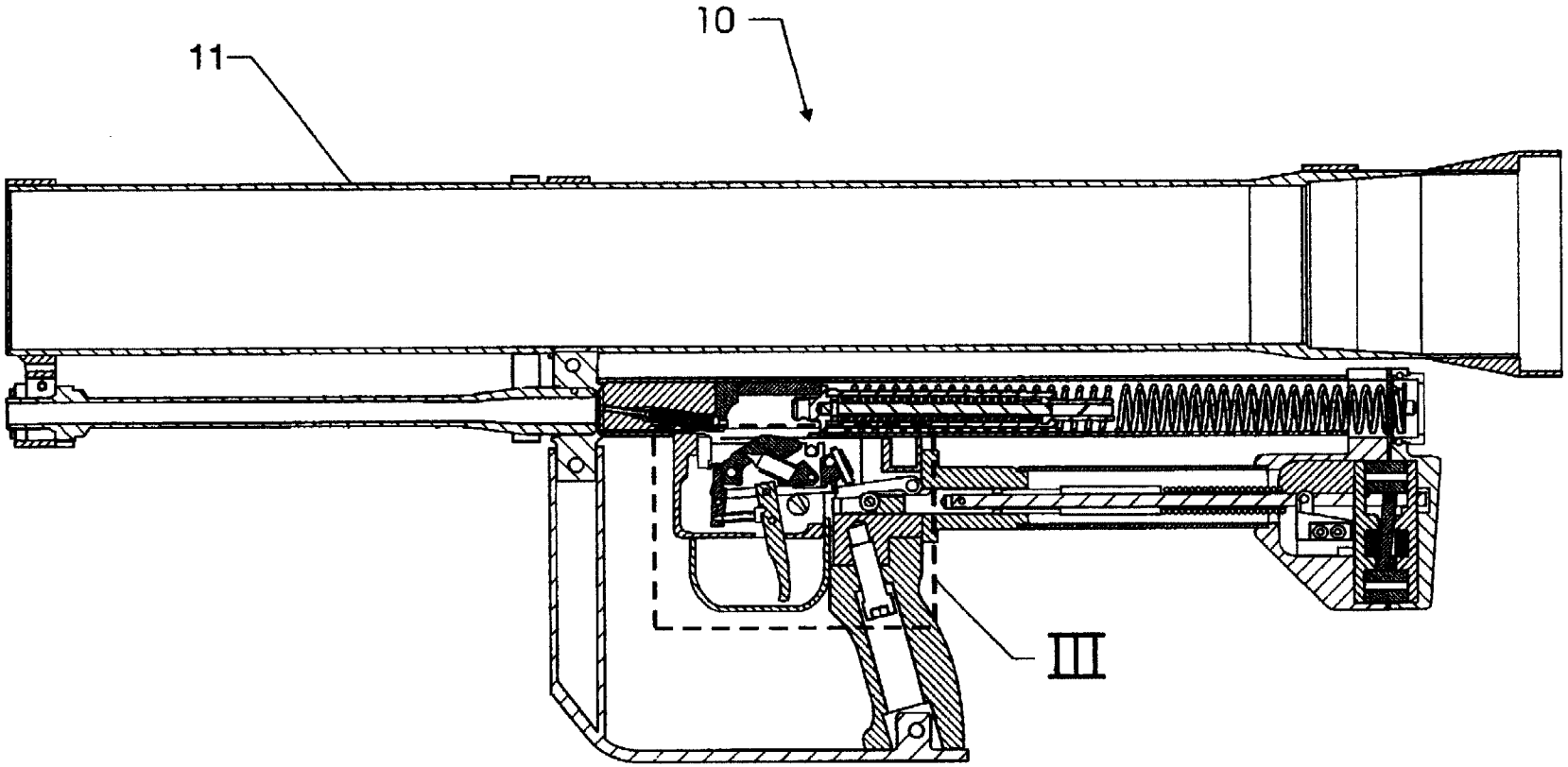
FIG. 2 a cross-sectional view of the shoulder-fired, multi-purpose assault weapon.
Figure 3:
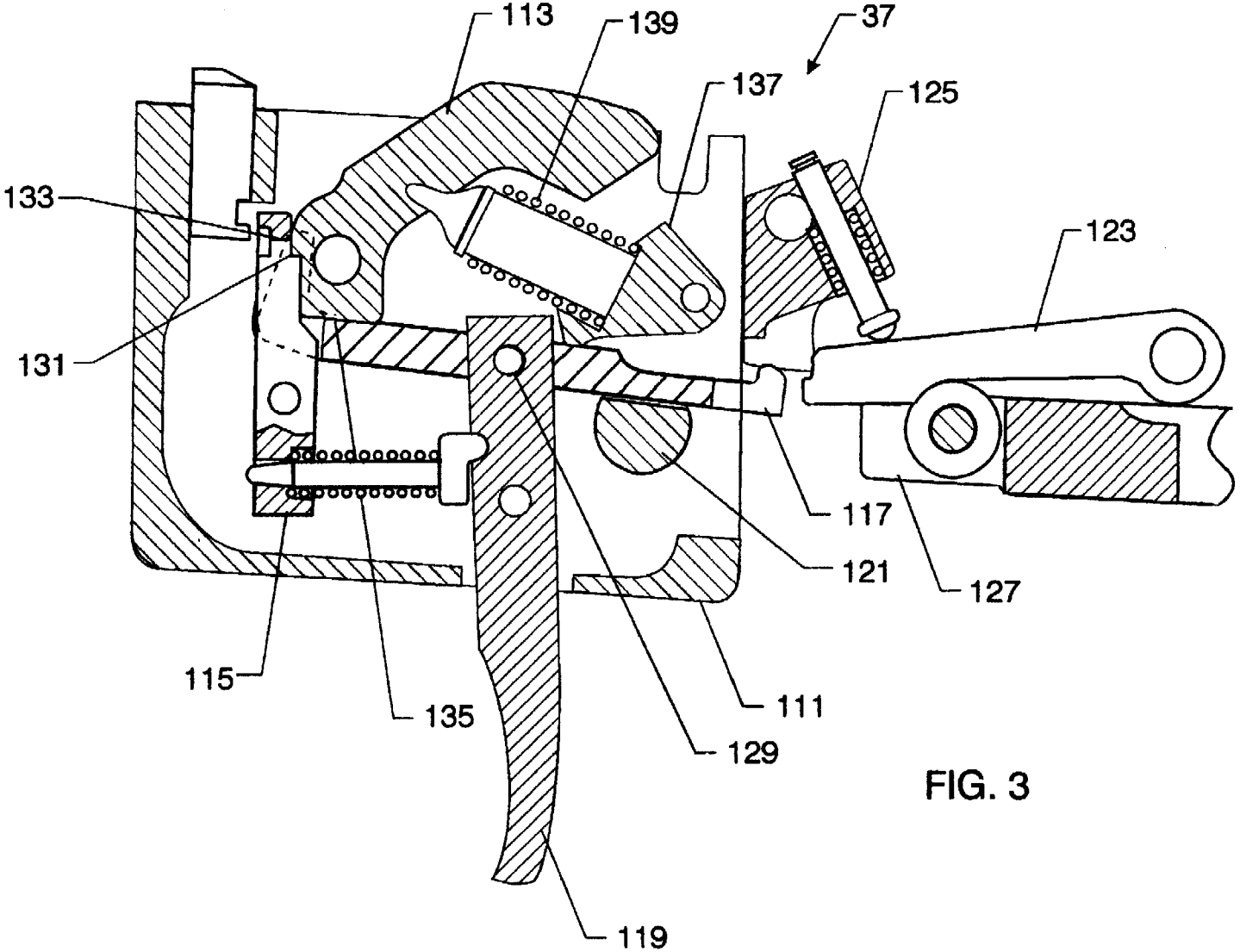
FIG. 3 is a dual firing mechanism with the primary sear engaging the connector link.

Referring now to FIG. 2, a cross-sectional view of the shoulder-launcher multi-purpose assault weapon 10 is shown with various sub-assemblies visible. The rocket tube 13 is identified for reference. The location of the trigger sub-assembly is shown by the dotted box labeled III. The components within this inside box III may be seen more clearly in FIG. 3.

The trigger assembly 37 comprises a single trigger dual firing mechanism operating a double sear and double hammer mechanism. The dual firing mechanism is mounted inside frame 111 which encloses the primary hammer 113, primary sear 115, a connector link 117 which is attached to trigger 119. A selector bar 121, which by rotating an eccentric cam section, adjusts the connector link for engagement of either the primary sear 115 or the secondary sear 123. The secondary sear prop 125, secondary sear 123, and the secondary hammer 127 are all housed outside frame 111 in the stock (shown in FIG. 2) of the spotting rifle. A key element of this invention is the pivoting connector link 117. The connector link 117 is pivotably mounted on the trigger by a horizontal pin 129. The primary sear 115 prevents the primary hammer 113 from rotating in a counter-clockwise direction by catching the hammer on the lug 131. As the trigger 119 is pulled, connector link 117 slides into contact with a lug 133 on the primary sear 115. The connector link 117 is forced into contact with the lower surface of the primary hammer at point 135 by the action of the connector link spring lever 137. Spring lever 137 is forced to rotate in a counterclockwise direction by the primary hammer spring 139. After contact between the connector link and the primary sear 115 is made at lug 133 further application of pressure to the trigger 119 will cause the sear to move counterclockwise out of contact with the primary hammer 113, allowing operation of the hammer. As depicted, the primary hammer 113 is a rotating type hammer of conventional design.

Figure 4:
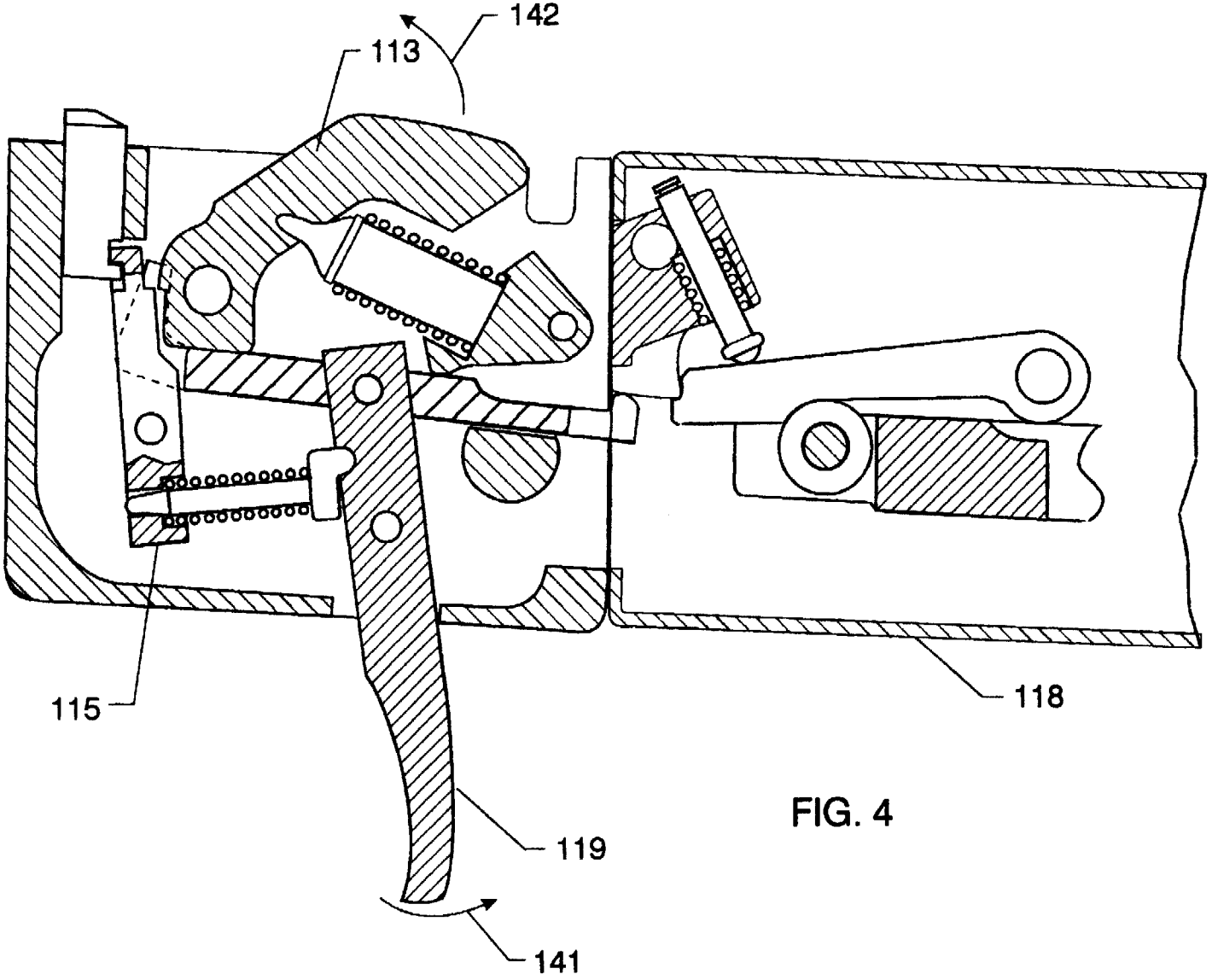
FIG. 4 is a cross-sectional view of the trigger assembly showing the operation of the primary sear.

Referring now to FIG. 4, operation of the primary hammer can be seen. As trigger 119 is depressed, as depicted by arrow 141, sear 115 moves out of contact with the primary hammer 113 which begins to rotate in a counterclockwise direction as shown by arrow 142. For reference, the stock 118 of the spotter rifle is shown mounting the secondary firing mechanism.

Figure 5:
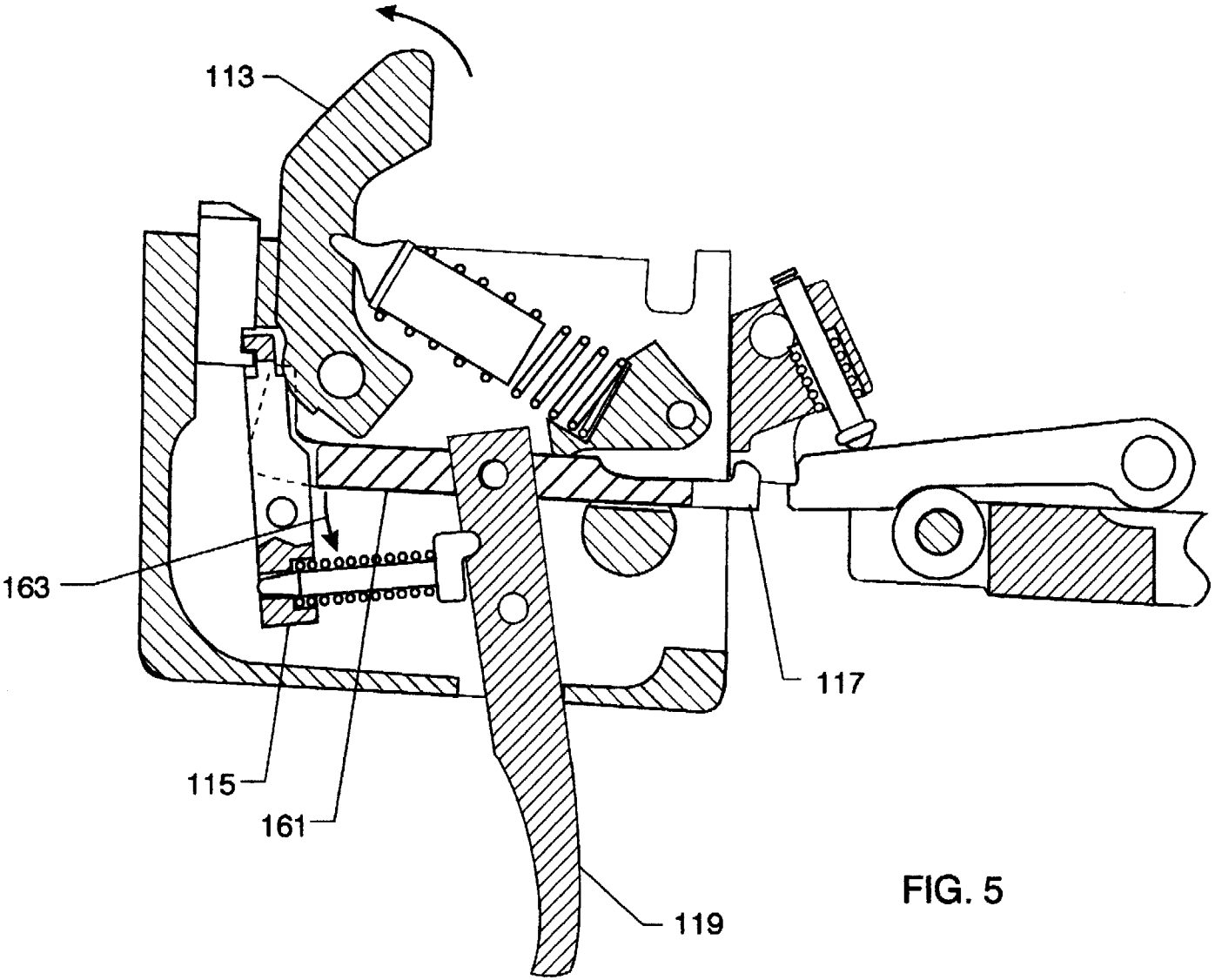
FIG. 5 is a cross-sectional view of the trigger assembly showing the primary hammer in the fully extended position.

Further operation of the primary hammer may be seen by referring to FIG. 5. In this figure, after the complete travel of trigger 119 the primary hammer 113 is in a fully extended position. The disconnector action of the pivoting connector link 117 is shown in this view where the tip 161 of the primary hammer 113 has caused the pivoting connector link to move in a downward direction as shown by arrow 163. In this position, the connector link 117 is no longer in contact with the primary sear 115. The sear 115 cannot rotate clockwise under the pressure of its spring (to re-engage the notch on the primary hammer) until the hammer is re-cocked. In order for the connector to come in contact with the sear, force must be removed from the trigger. Releasing the trigger allows the connector link to move rearward and reengage the sear.

Figure 6:
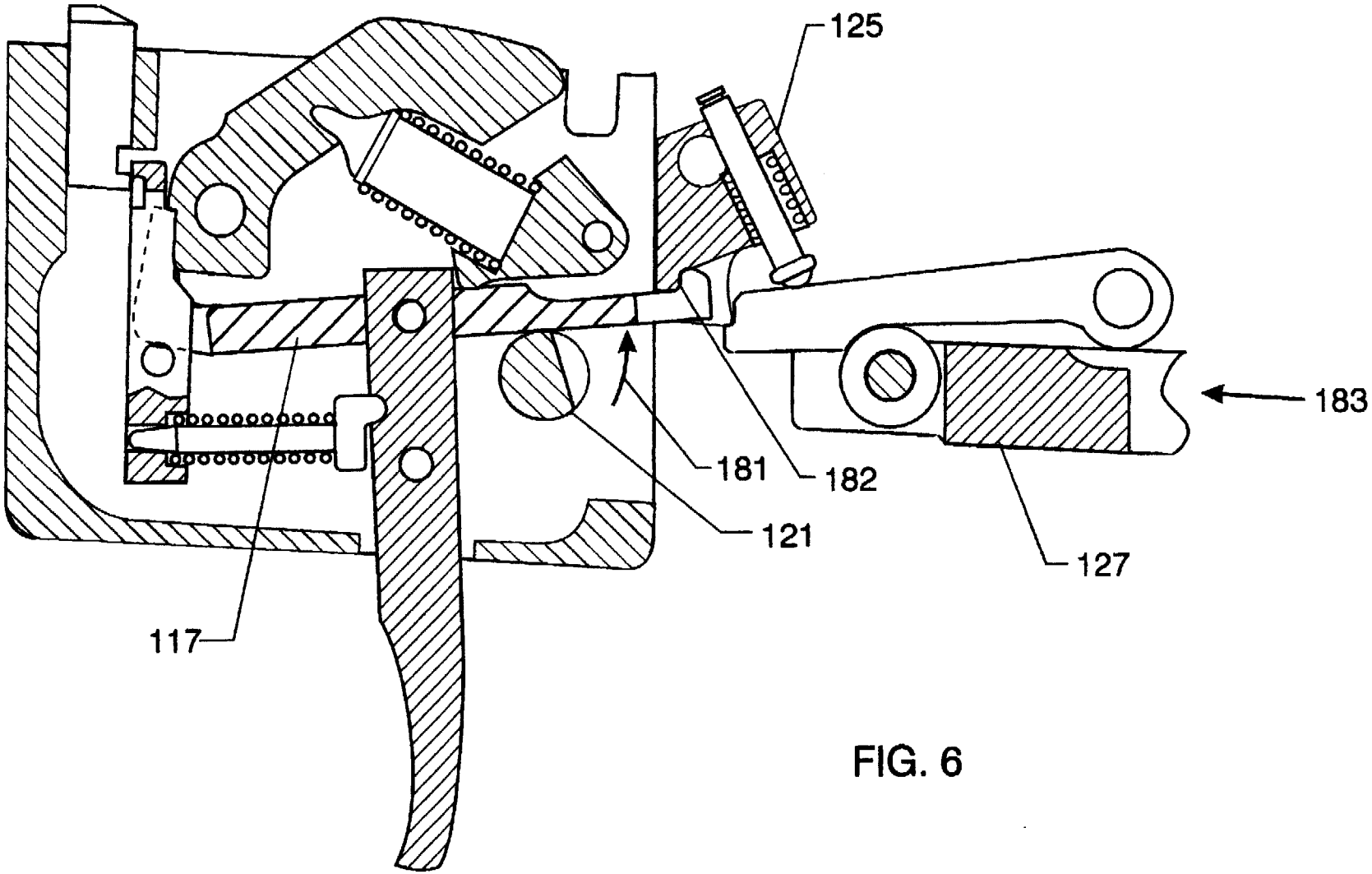
FIG. 6 is a cross-sectional view of the trigger assembly showing the connector link engaging the secondary sear assembly.

Referring now to FIG. 6, operation of the secondary sear and hammer can be seen where selector bar 121 is rotated, as shown in a clockwise direction. The connector link 117 is forced to rotate in a counterclockwise direction as shown by arrow 181. This rotation causes an engagement with the second sear prop 125 at lug position 182. A spring force, represented by arrow 183, is applied to the secondary hammer 127. The secondary hammer 127 is a plunger or piston type hammer which operates by sliding left and right in this depiction.

Figure 7:
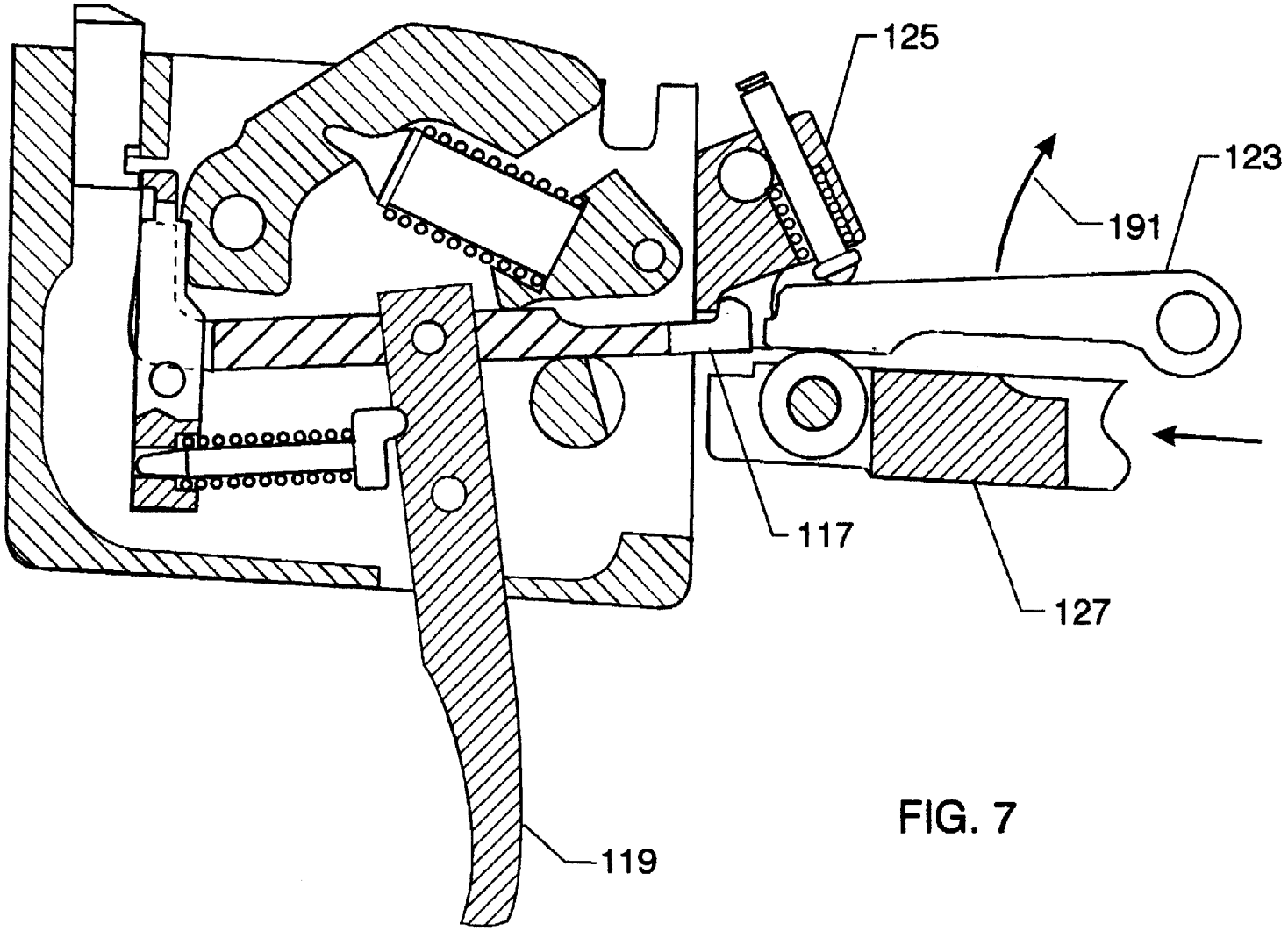
FIG. 7 is a cross-sectional view of the trigger assembly showing the secondary sear tripped.

Referring now to FIG. 7, with the trigger 119 fully depressed, the sear prop 125 is pulled by the connector link 117 out of contact with the secondary sear 123, thereby allowing the secondary hammer 127 to force the secondary sear 123 to rotate clockwise (depicted by the rotation arrow 191) as it moves to the left.

Figure 8:
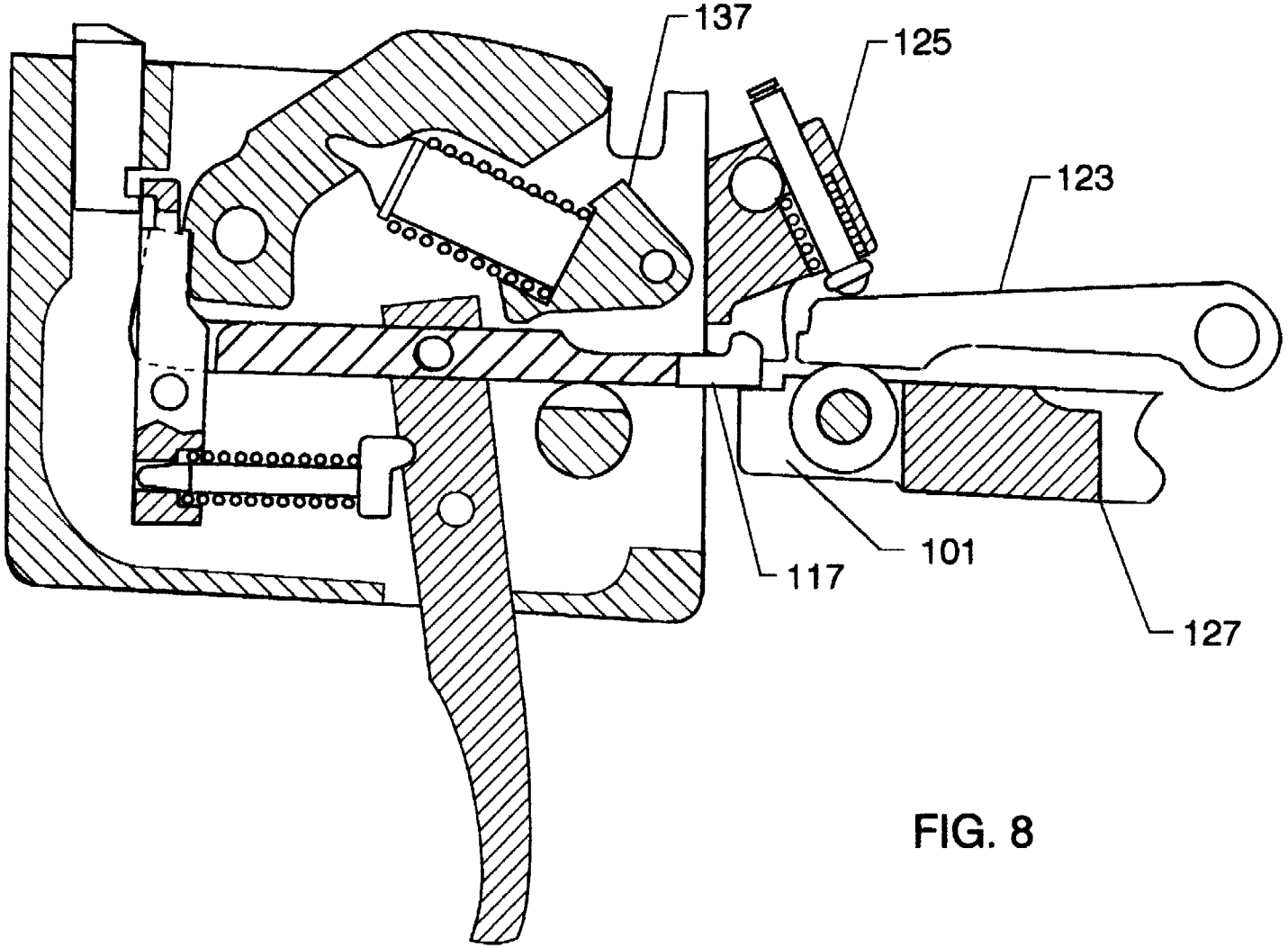
FIG. 8 is a cross-sectional view of the trigger assembly showing the secondary hammer fully extended and preventing connector link engagement.

Referring now to FIG. 8, the secondary hammer 127 is shown at the extent of its movement. The hammer nose 101 lies in a position to prevent connector link 117 from rotating clockwise under force from the connector link spring lever 137. In this position, the connector link 117 cannot engage either sear mechanisms. Further firing of the spotting rifle after firing the main round is prevented by this sear location.

Figure 9:
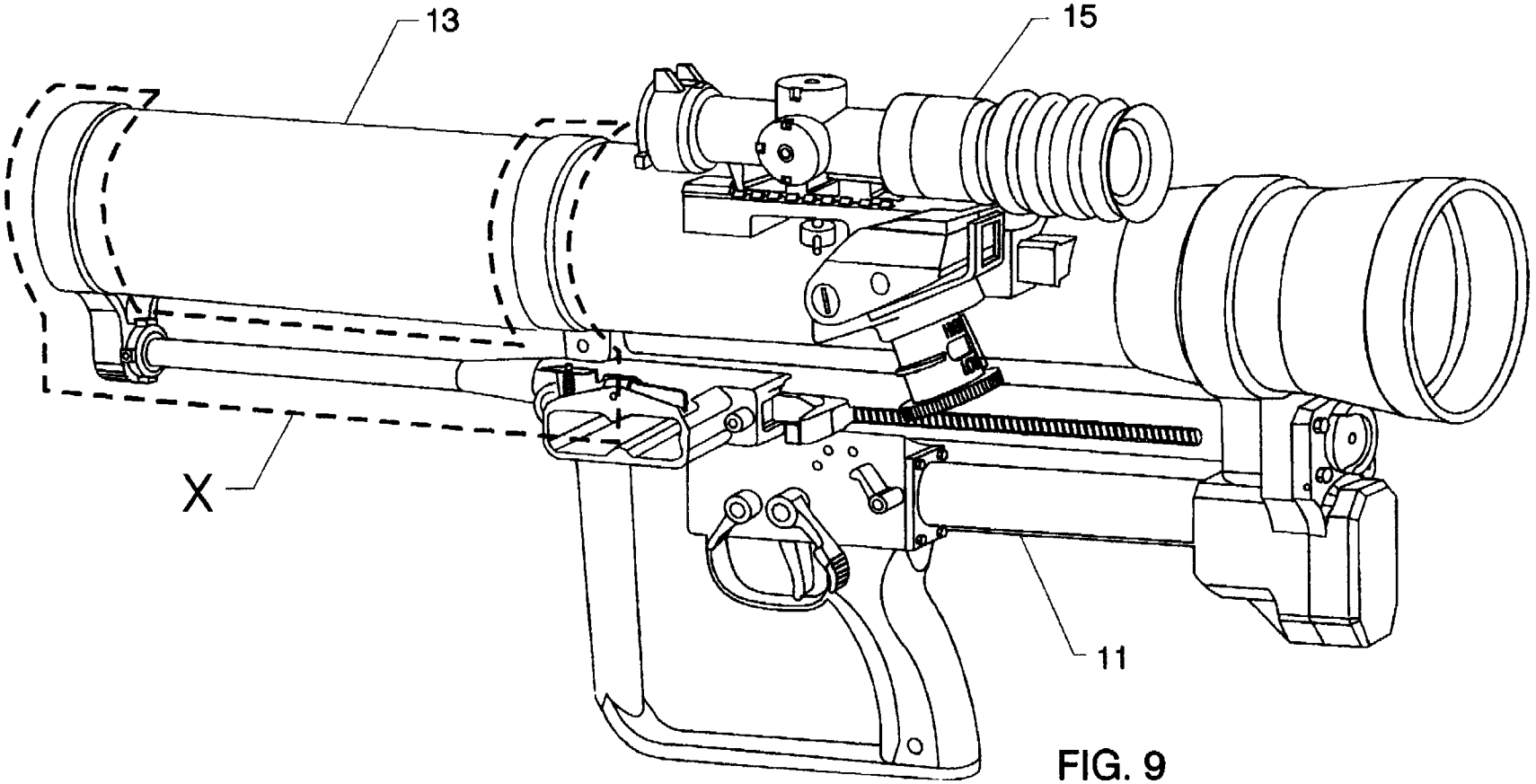
FIG. 9 is a perspective view of a rocket launcher showing the spotting rifle barrel alignment mechanism.

As depicted in FIG. 9, the location of the spotting round bore alignment mechanism is shown in dotted area X for reference. The rocket launcher tube 11 serves as a mount for the spotting rifle 15 and the sight unit 13. The details of the spotting round bore alignment mechanism as shown in dotted area X, may be seen in more detail in FIG. 10.

Figure 10:
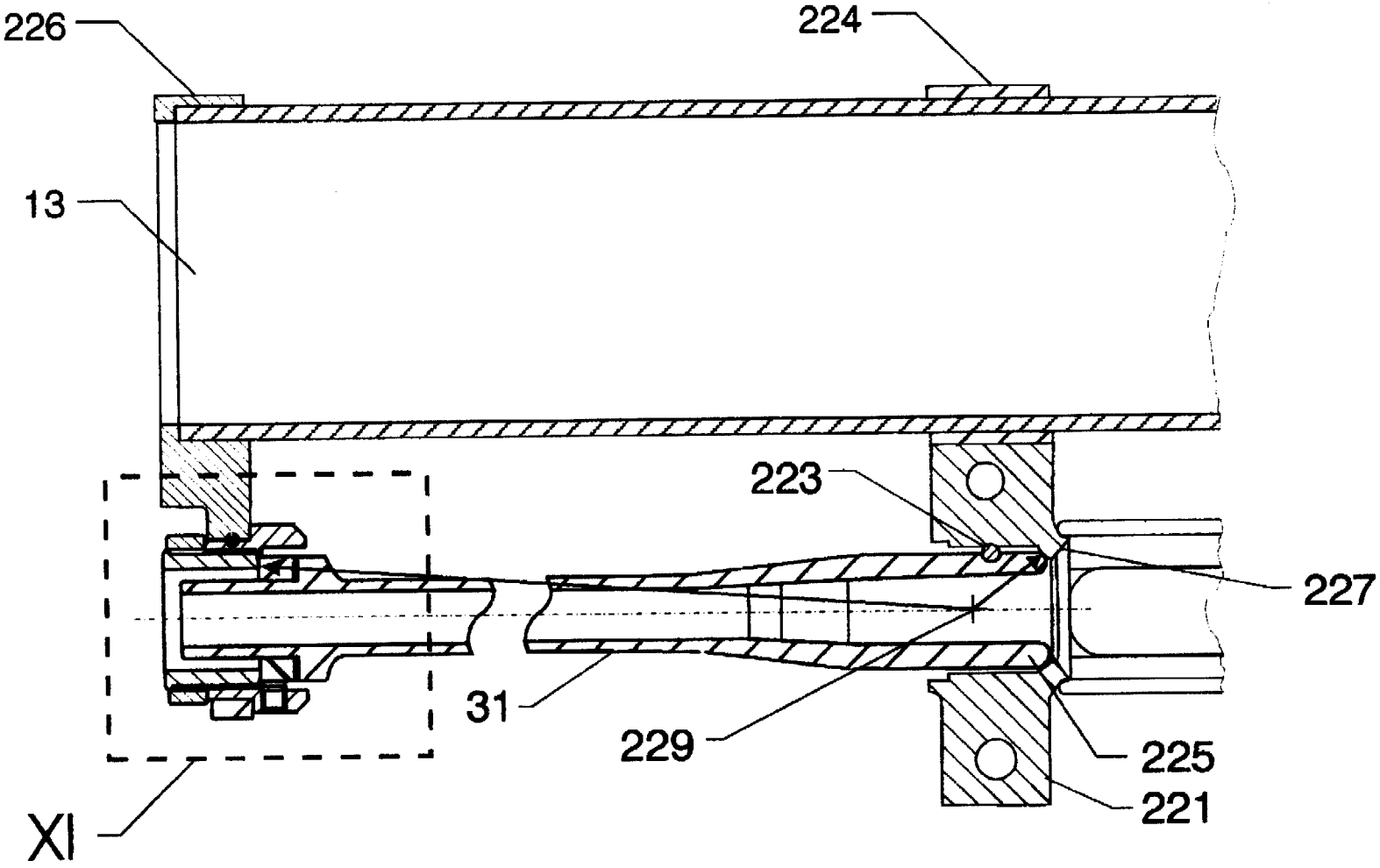
FIG. 10 is a partial cross-sectional view showing the spotting rifle barrel alignment components.

Referring now to FIG. 10, the muzzle end of the rocket launcher tube 13 is shown for reference with the spotter rifle barrel 31 attached beneath the rocket launcher tube. The barrel 31 has a retaining pin 223 to hold it attached to the receiver block 221. The bore alignment mechanism uses a convex spherical or near spherical convex surface on the rear of the barrel 31 which is mated to a concave conical surface on the receiver 227. The receiver block 221 is rigidly affixed to the main launching tube 13 by receiver ring bracket assembly 224. At the muzzle end, supports for the spotting rifle barrel are attached using the muzzle ring bracket assembly 226. The radius of the breech shoulders of the barrel 31 is located at point 229. This location of the radius center is approximately a distance of one external barrel radius forward of the breech end of the spotter barrel. This radius location 229 allows a pivoting of the barrel in a small arc to adjust the rear interface of the barrel with the receiver. Adjustment of the angle of the barrel is accomplished by adjustment of the screws in dotted section XI. These details are shown more fully in FIG. 11.

Figure 11:
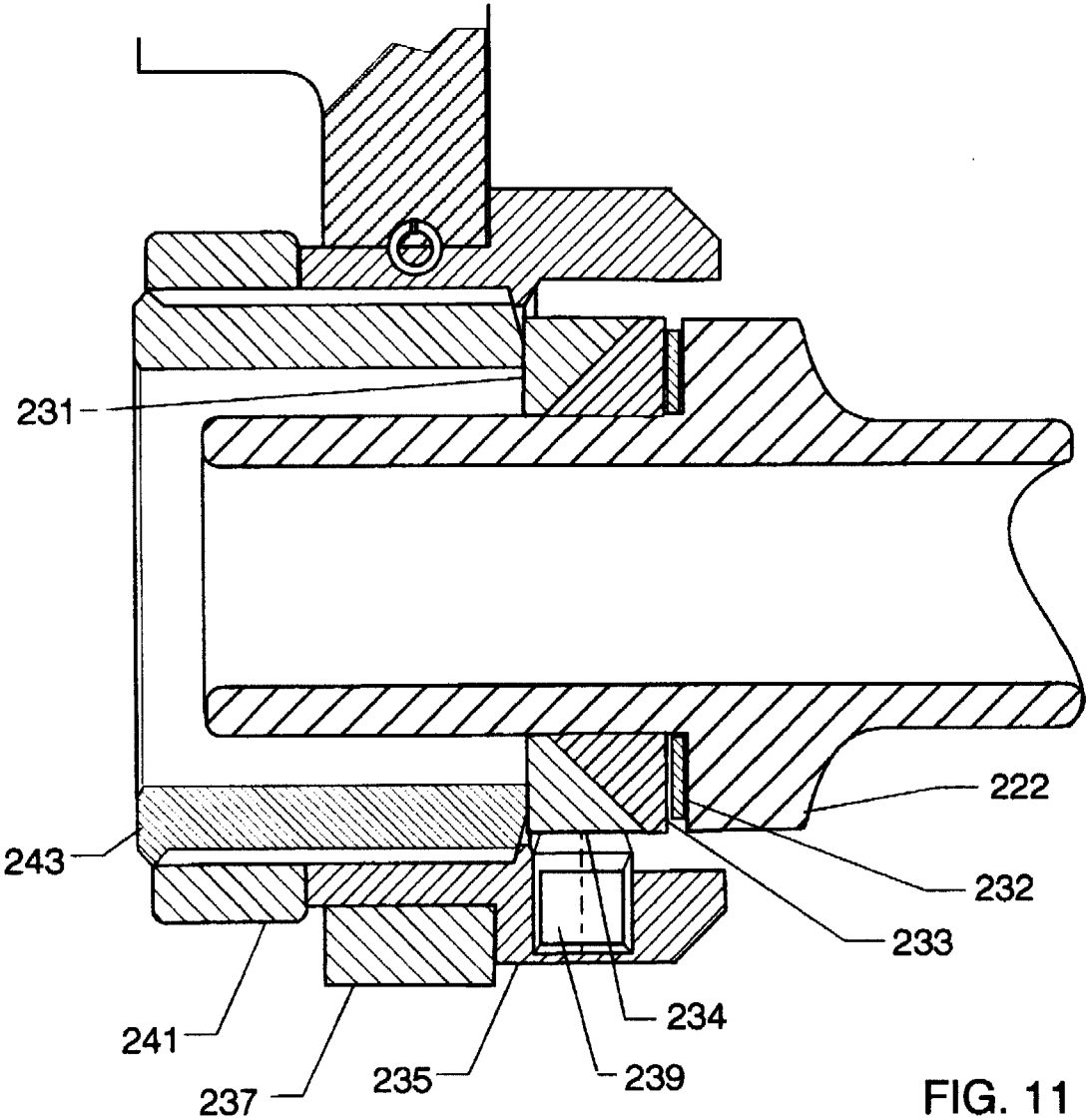
FIG. 11 is a partial cross-sectional view showing the muzzle end of the spotting rifle barrel.

Referring now to FIG. 11, barrel 31 is shown for reference. Immediately ahead of the muzzle shoulders of the barrel 31 is a circular spring and washer assembly. This assembly includes a compression spring 232 which allows slight forward movement of the barrel. Immediately ahead of the compression spring 232 is a grip collar 233. Grip collar 233 is a split ring design allowing expansion of the collar depending on temperature of the barrel and also allowing a clamping effect as the grip collar is forced towards adjacent locating washer 234. The locating washer 234 is adjusted by three adjustment screws 239 (only one of which is shown here for clarity), each of the screws being located 120° around the barrel. The barrel locating bushing 235 is fixed around the muzzle end of the barrel and is itself encircled by bracket 237 which attaches to the main launcher tube not shown in this figure. A jam nut 241 secures the assembly to the barrel. A barrel collar 243 acts as a support for the locating washer with respect to forward movement. Barrel collar 243 seats against locating washer 234 with a rounded surface. The locating washer 234 itself also has a spherical surface as shown by surface 231 wherein the radius of the forward side of the locating washer is drawn from center 229 shown in FIG. 10. As a result of these radii being located around a common center 229, the barrel can be rotated slightly while maintaining snug contact with the fixed receiver breech surface.

The common radii centers of grip collar 233 and of the breech shoulders 225 (around center 229) allow the barrel to be adjusted up and down and laterally to make an exact parallel match to launcher tube. As surfaces at the muzzle end and rear end of the barrel are radiused off the common center, there is no gap, extension, or spaces developed due to pivoting of the barrel. Additionally, conical surfaces shown on grip collar 233 and the matching conical surface on locating washer 234 allow an expansion of the barrel due to heat. As a result of these features, the spotting rifle barrel can be aligned to provide an exact parallel axis with the main longitudinal axis of the launcher tube and will remain in that position even after repeated firings and after heating of the barrel. As the barrel expands, compression of spring 232 takes care of linear expansion of the barrel and the expansion of the split grip collar compensates for cross-sectional expansion of the barrel.

Figure 12:
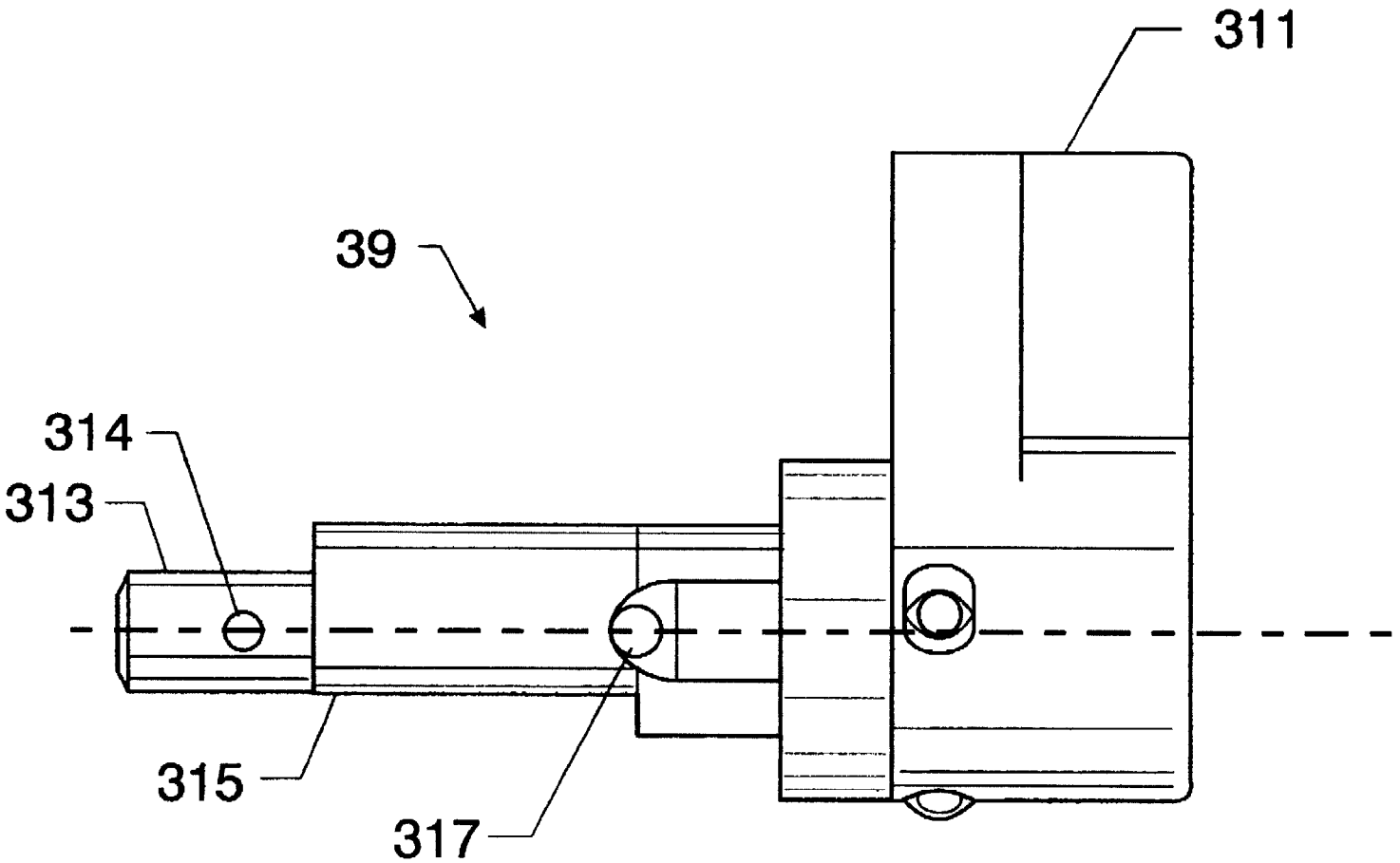
FIG. 12 is a side view of the combination pin.

Another novel feature of the invention is the means of securing the trigger assembly 37 as depicted in FIG. 12. The trigger assembly is held in place by a combination pin 39 which serves both for attaching the trigger assembly and for safing the spotting rifle. The combination pin 39 comprises a handle 311 attached to a retainer pin and cam assembly, the retainer pin 313 having a ball-locking mechanism 314. The cam 315 provides an eccentric movement during rotation in order to enable the trigger assembly. At the end of the cam 315 nearest handle 311, a detent-engagement mechanism 317 is affixed.

Figure 13:
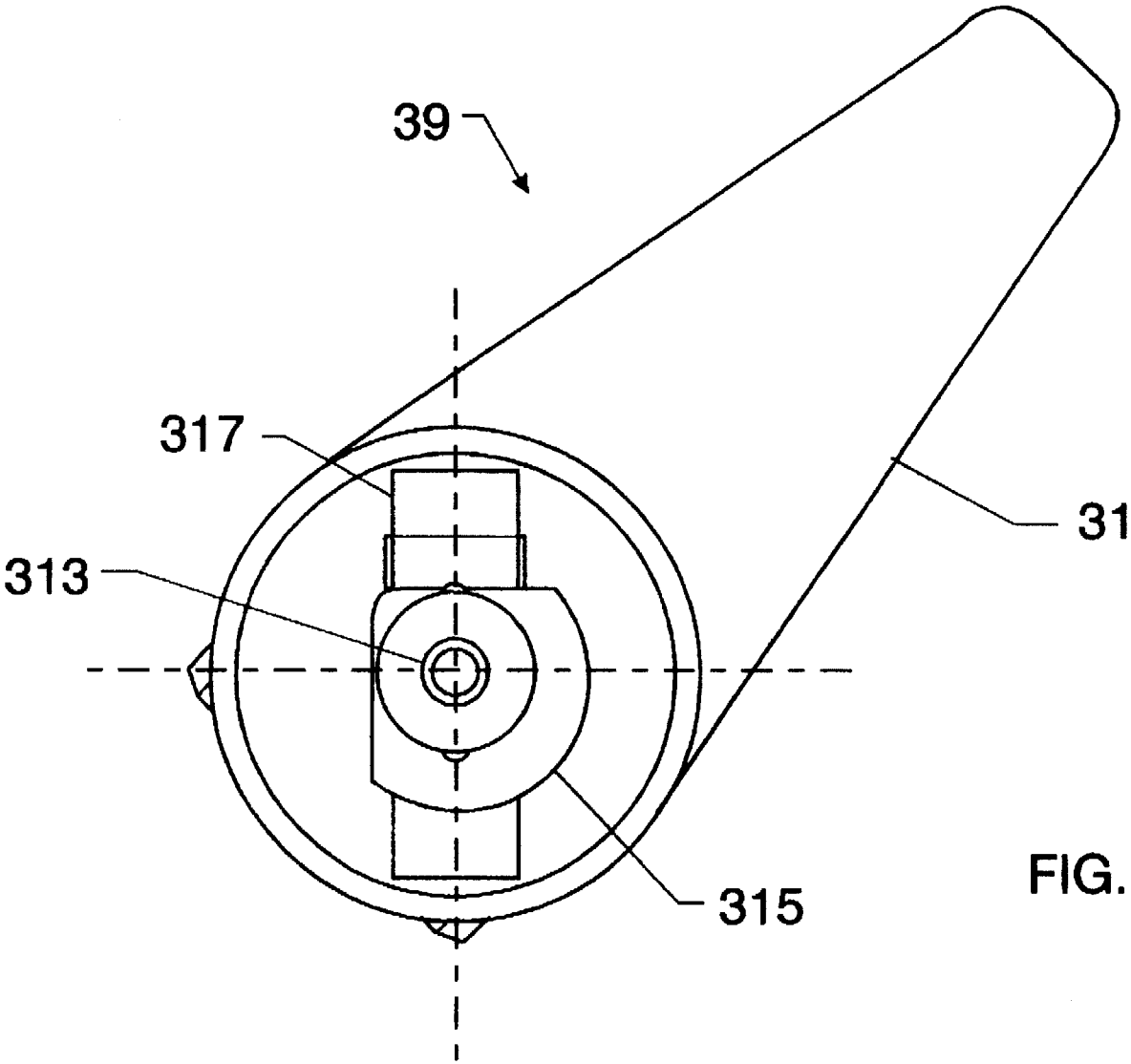
FIG. 13 is an end view of the combination pin.

The shape of the combination pin 39 components may be further understood by reference to FIG. 13. The handle 311 is rotationally fixed in relation to cam 315 so that the extended cam covers a one-half circle on the lower right side of the handle 311. With the handle 311 in this position, the safety detent-engagement mechanism 317 is at the top location, 45° away from the center line of handle 311 and located on the non-cam side of the retainer pin 313.

Figure 14:
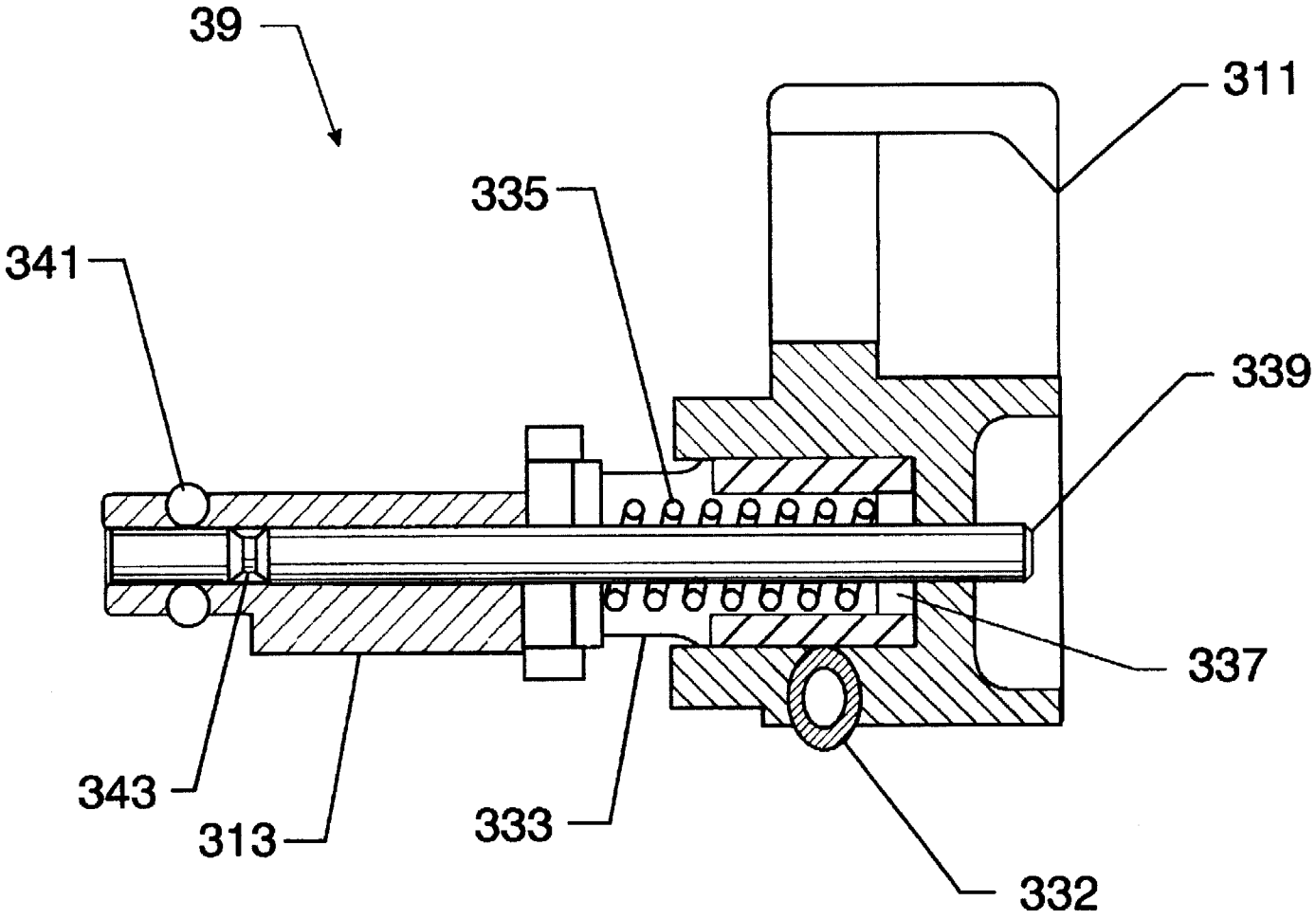
FIG. 14 is a sectional side view of the combination pin.

As shown in FIG. 14, a sectional view of the combination pin 39 details the internal mechanism of the assembly. Handle 311 is attached to the retainer pin and cam assembly 313 and is held in place by spring pin 332. The retaining pin and cam assembly (shown with narrow cross-hatching) extends from inside handle 311 to the insertion end of the device. The retainer pin and cam assembly is a single piece housing having a smaller center bore on the insertion end and a larger center bore on the handle end. Two slots 333 are cut through the assembly to allow movement of the detent-engagement mechanism. A dual-action spring 335 presses the detent-engagement mechanism toward the insertion end of the combination pin. The dual-action spring 335 also presses against washer 337 which is affixed to the ball locking rod 339. This action urges the ball-locking rod 339 toward the handle end of the combination. With the ball locking rod in the position shown (outward toward the handle), the locking balls 341 cannot retract and the combination pin 39 is held in place to secure a trigger assembly to a weapon. When ball-locking rod 339 is pressed inward from the handle 311, the locking balls 341 are aligned with the groove 343 in the locking rod 339 thereby releasing the pin and the entire combination pin can then be removed from the trigger assembly.

Figure 15:
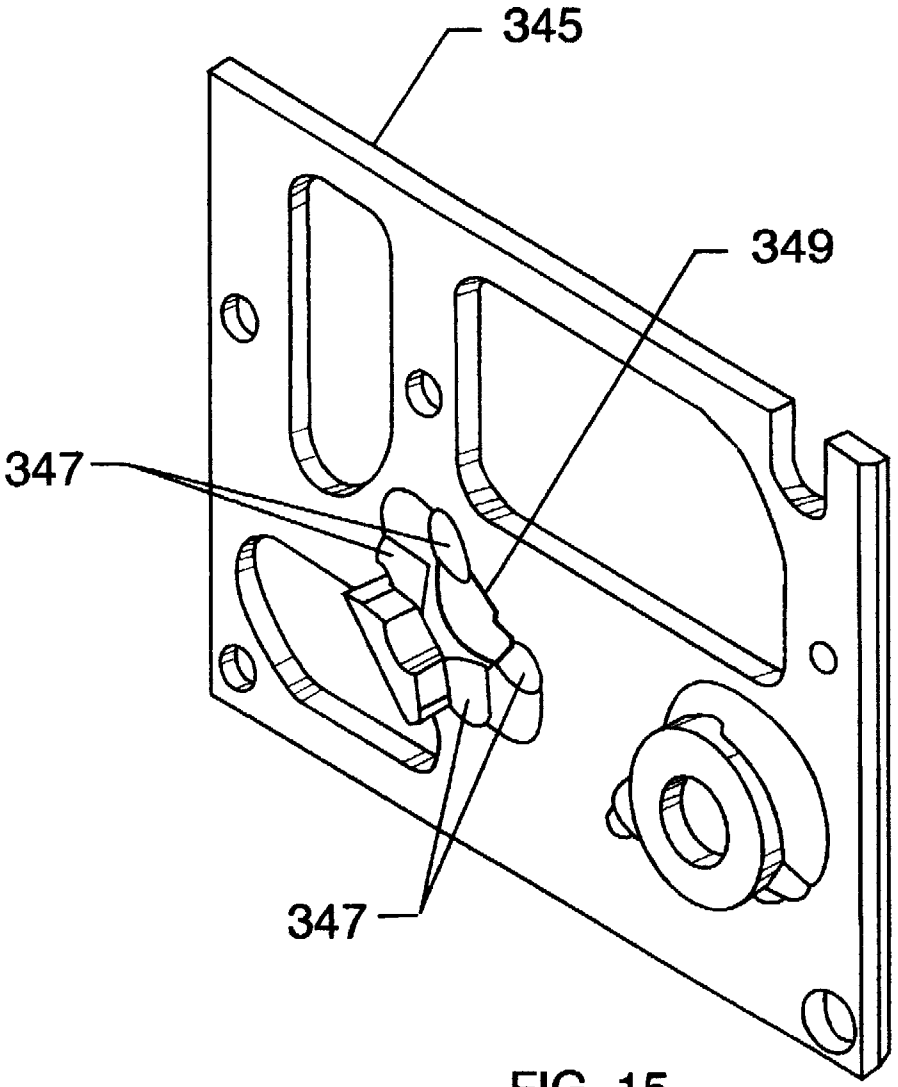
FIG. 15 is a perspective view of a trigger housing plate.

FIG. 15 shows a trigger housing plate 345 which mates with the combination pin to provide detents 347 for the detent-engagement mechanism. Aperture 349 is shaped to match the cam shape of the Combination pin thereby allowing insertion of the combination pin only in the safe position. After insertion, the combination pin may be rotated to arm the weapon.

Figure 16:
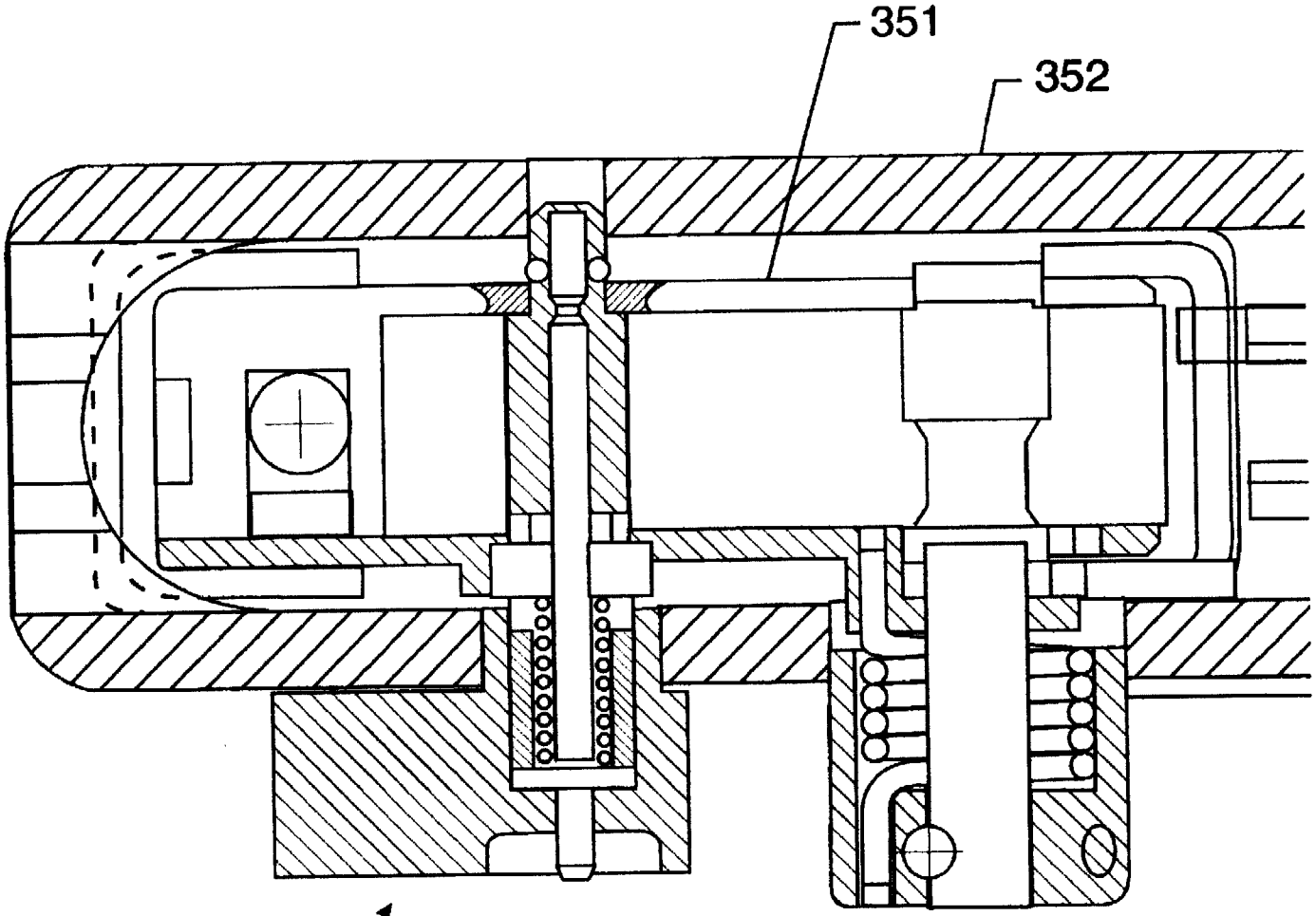
FIG. 16 is a cross-sectional top view showing the combination pin installed in a trigger assembly.

Referring now to FIG. 16, the combination pin 39 is shown inserted in the trigger assembly 37. The depiction is a top view looking downward. The trigger assembly 37 is inserted into the weapon from the bottom and the combination pin 39 is then inserted from the side as shown. As the cam action of the pin is required to enable the weapon, the weapon is safe whenever the pin is removed. Additionally, due to the shape of the aperture, the combination pin 39 must be inserted in the safe position and fully seated before it can be rotated to the arm position. This feature means that the safety of emergency field disassembly of the weapon is greatly enhanced.

Figure 17:
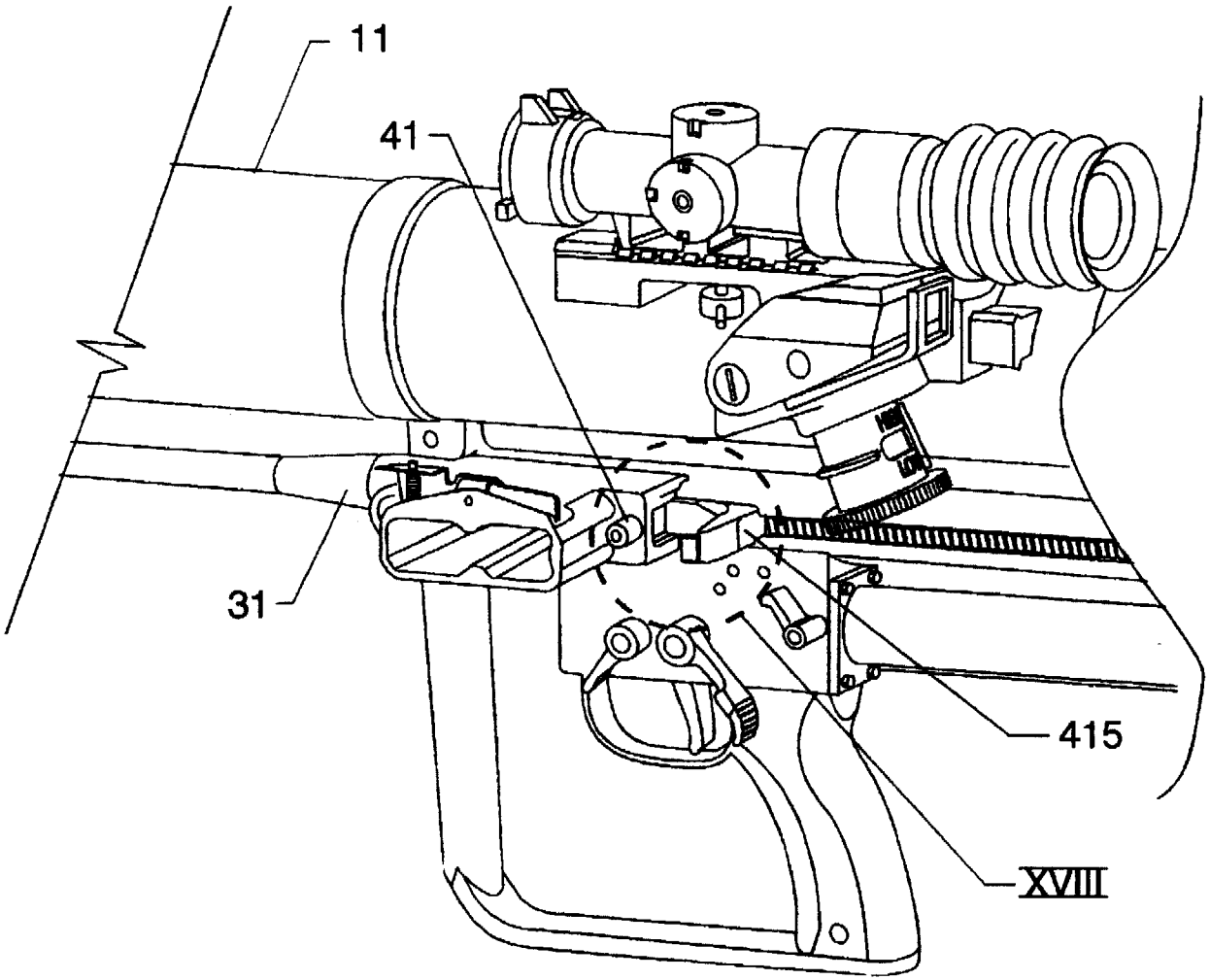
FIG. 17 is a partial perspective view of the shoulder-launched weapon showing location of the combination bolt lockback and cartridge ejector.

Referring to FIG. 17, another novel feature of the SMAW may be seen in the single spring bolt lockback and cartridge ejector 41. The rocket tube 11 and the spotter rifle barrel 31 are shown for reference.

Figure 18:
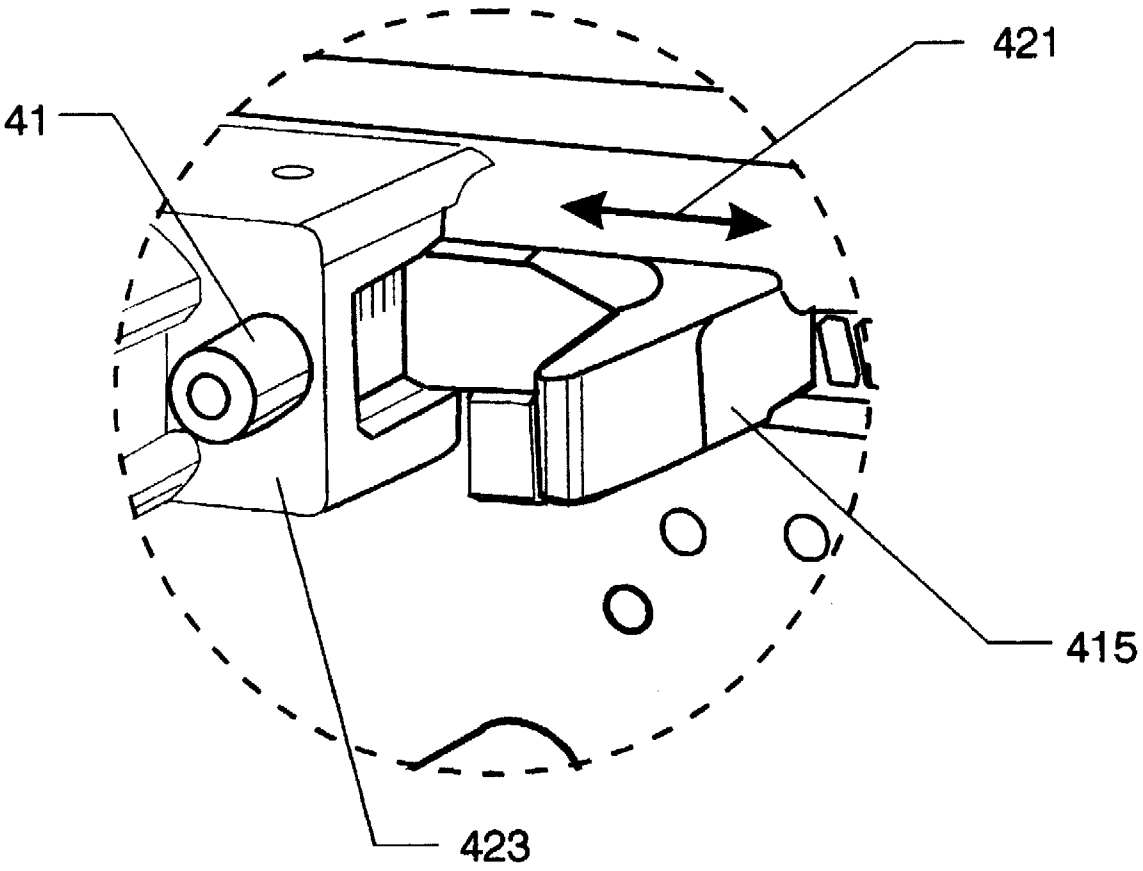
FIG. 18 is a partial perspective view showing the combination bolt lockback and cartridge ejector.

The details of the combination bolt lock and cartridge ejector mechanism 41 may be seen in FIG. 18 which is an enlargement of the dotted circle II of FIG. 17. The bolt operates in left and right directions as depicted by arrow 21. The combination bolt lock and cartridge ejector mechanism 41 moves in and out as depicted by arrow 23. When the bolt is drawn back to a rearward position (to the right in the Figure), the combination bolt lock and cartridge ejector mechanism can be depressed by an operator causing the bolt lock to slide in front of the bolt as depicted by arrow 23, thereby locking the bolt open. The entire mechanism is held in place by pin 25.

Figure 19:
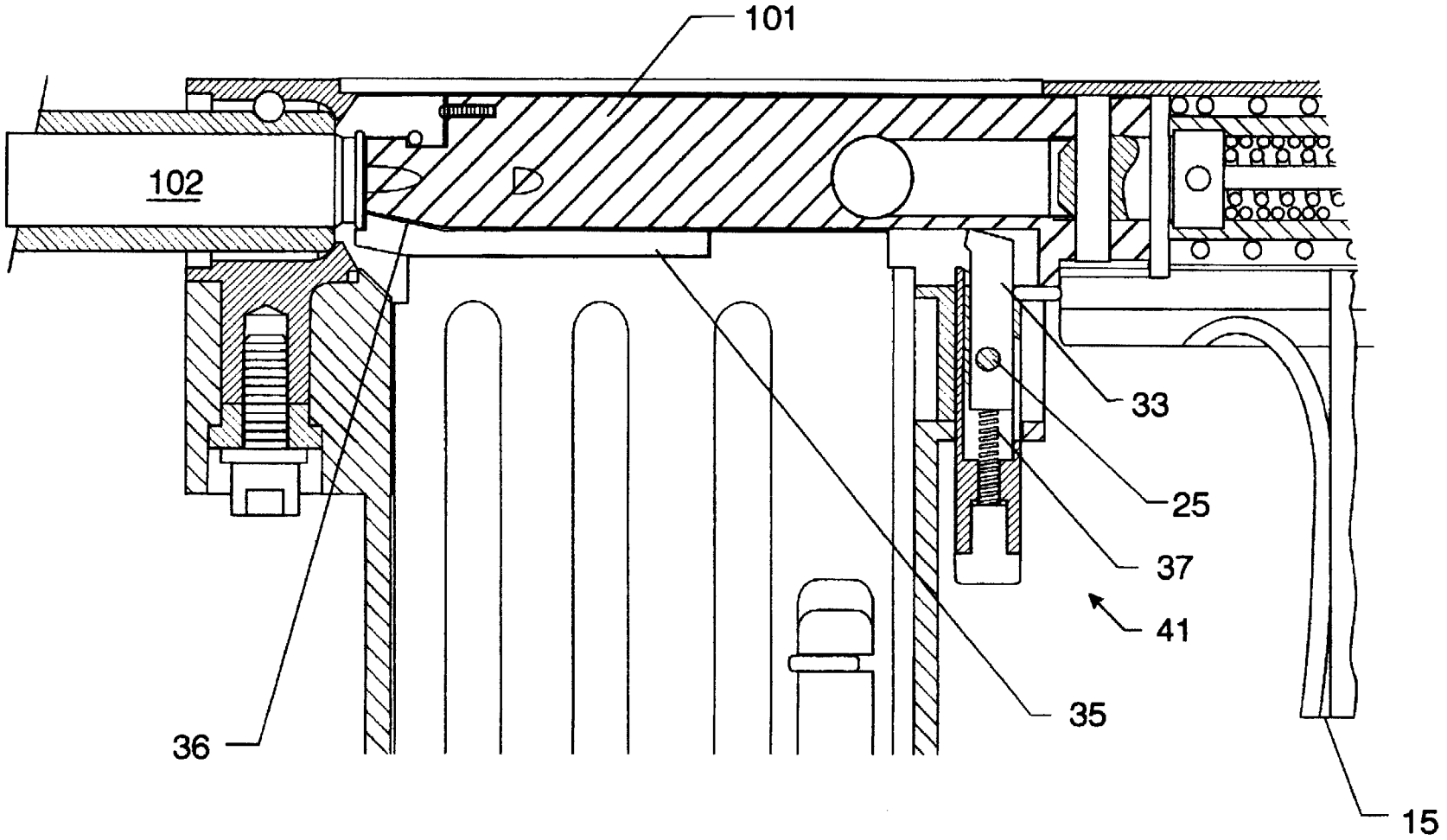
FIG. 19 is a cross-sectional top view showing the combination bolt lockback and cartridge ejector with a chambered shell.
Figure 20:
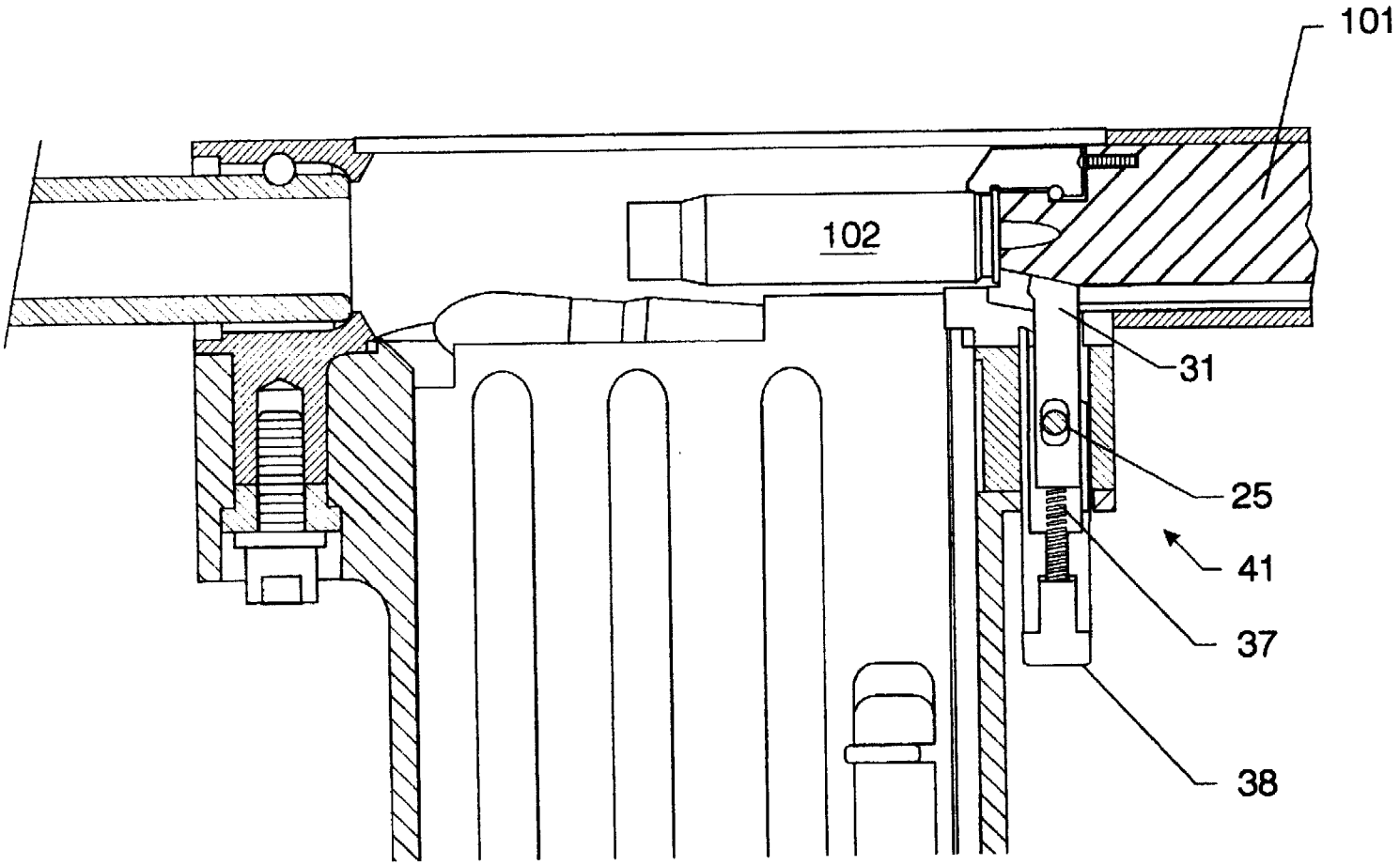
FIG. 20 is a cross-sectional top view showing the combination bolt lockback and cartridge ejector showing an expended cartridge being extracted.

Referring now to FIG. 19, the operation of the combination bolt lock and cartridge mechanism 41 may be seen in relation to the operating bolt 101. As depicted in this figure, bolt 101 is in the forward position with the cartridge 102 in the firing position. The cartridge ejector 33 with bolt 101 in the forward position, is pushed outward (down in the Figure) away from the centerline of the bolt 101. The cartridge ejector 33 slides along a slot 35 in the bolt 101. As the bolt 101 is retracted, a beveled section 36 of slot 35 allows the ejector 33 to slide inward toward the center of the bolt 101. A single ejector and locking spring insures that the ejector remains snug against the bottom of the slot 35. This action is more clearly depicted in FIG. 20 wherein the bolt 101 is shown nearing the rearward position and ejector 33 is beginning to extend inward to engage the spent cartridge 102. Single ejector and locking spring 37 urges ejector 33 toward the center of bolt 101. The single ejector and locking spring 37 also presses against the bolt lock 38. The bolt lock 38 is a hollow cylindrical tube having a slot on the rearward edge (right hand side) for ejector 33. Although now shown in this cross-sectional view, it has an elliptical hole for pin 25 identical to the elliptical hole shown in the ejector 33.

Figure 21:
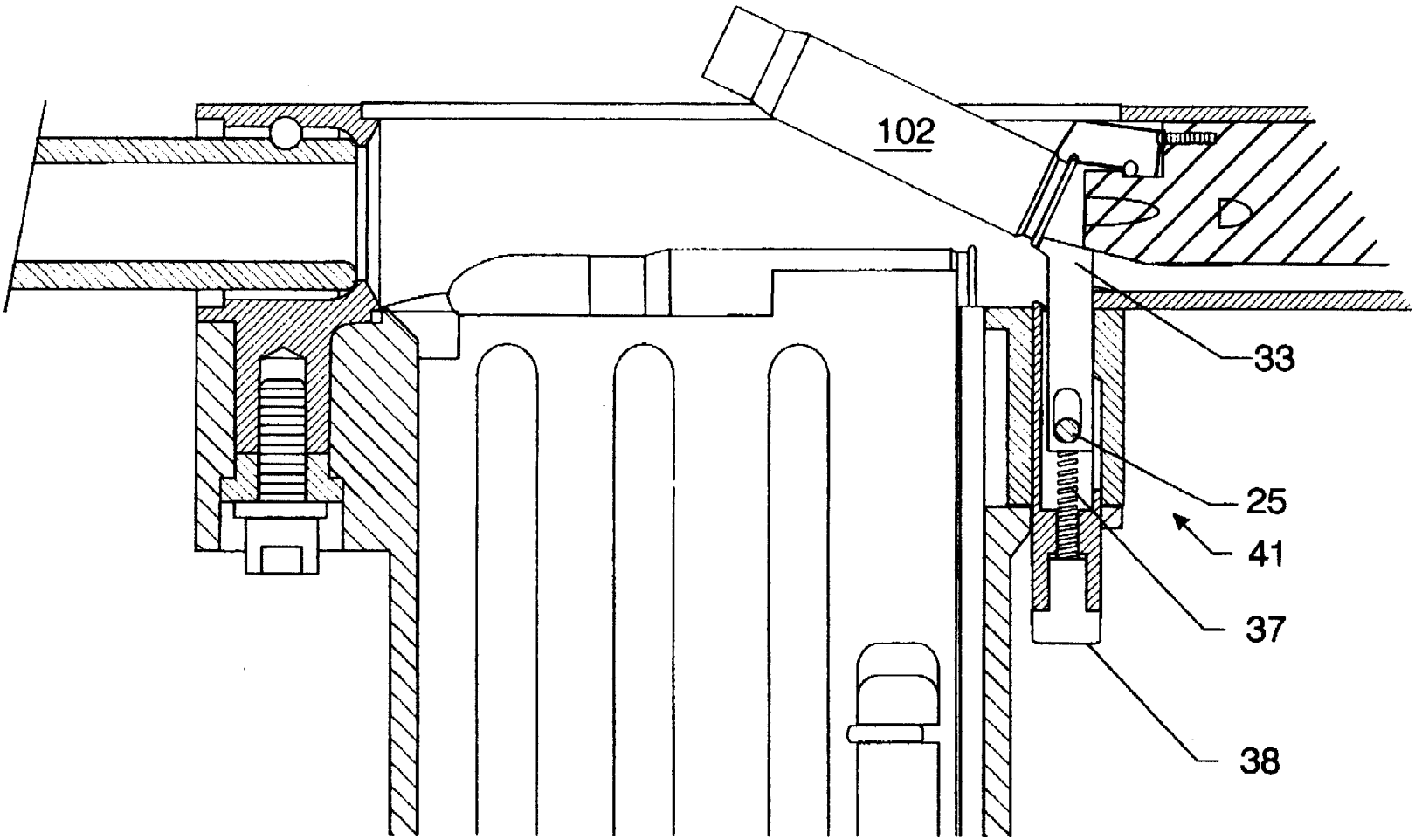
FIG. 21 is a cross-sectional top view showing the combination bolt lockback and cartridge ejector with an expended cartridge being ejected.

Referring now to FIG. 21, the spent cartridge 102 is being ejected as shown with the ejector cartridge 33 in the fully extended position. Further extension of the ejector 33 is prevented by the elongated hole located at pin 25. As may be seen in this view, the single spring bolt lock and cartridge ejector spring 37 is in its most extended position.

Figure 22:
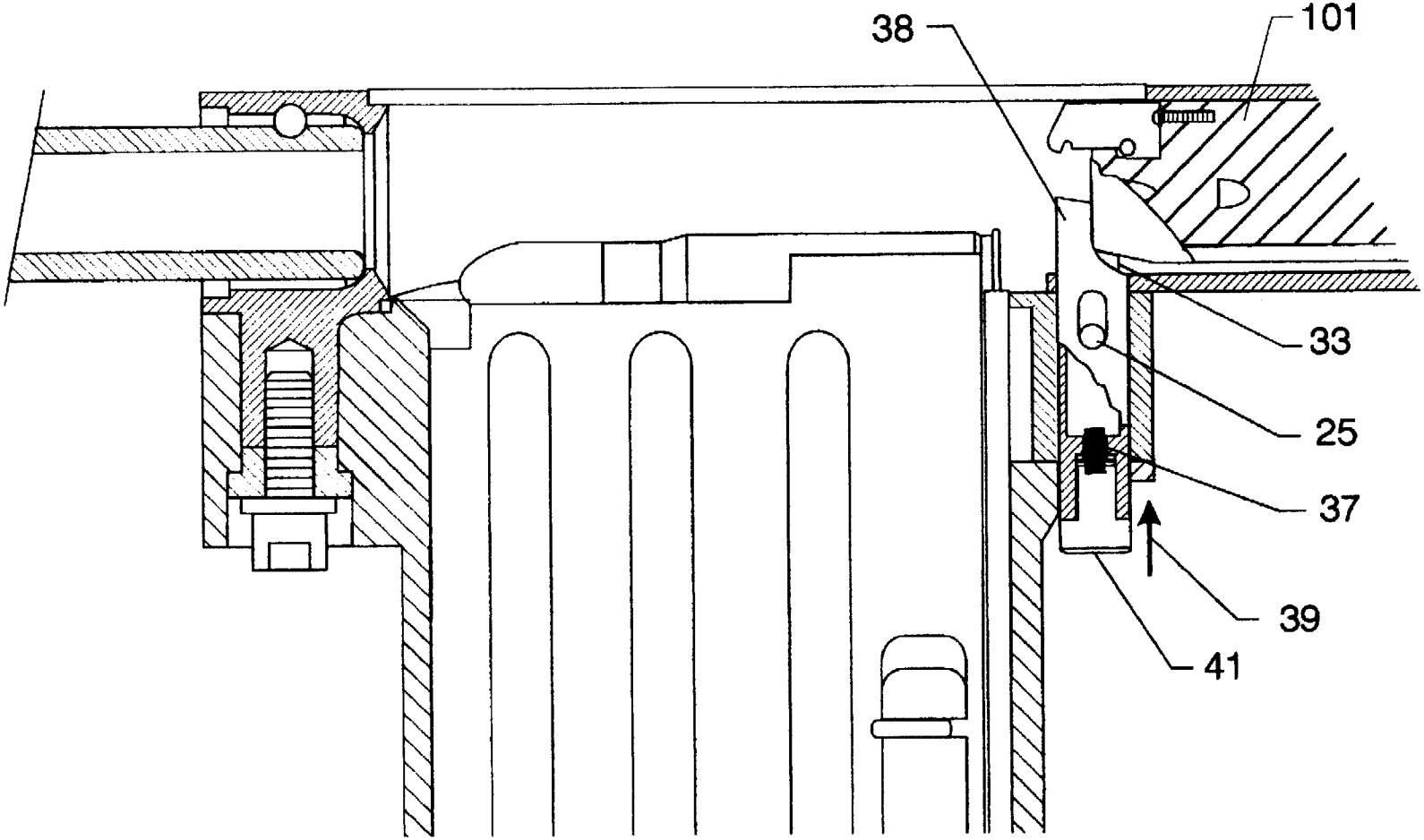
FIG. 22 is a cross-sectional top view showing the combination bolt lockback and cartridge ejector with the bolt locked back.

Referring now to FIG. 22, with the bolt 101 held in the full aft position, the bolt-engaging end of the invention may be engaged by depressing the bolt lock 38 as shown by arrow 39. Moving the bolt lock 38 inward compresses the single spring bolt lock and cartridge ejector spring 37 and moves the lock 38 to the full travel of the elongated hole at pin 25.

Figure 23:
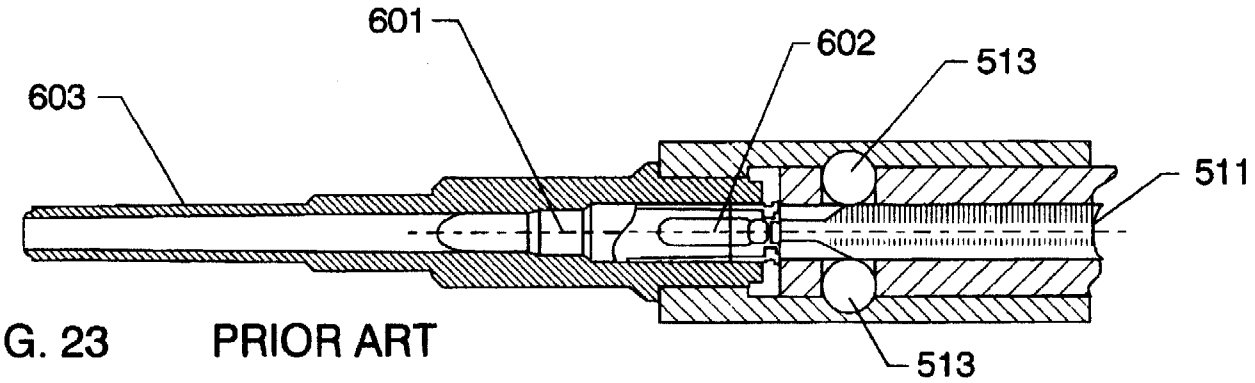
FIG. 23 PRIOR ART
FIG. 23 is a cross-sectional view of a typical prior art breech locking mechanism for a spotter rifle with the bolt in the forward position ready for firing.
Figure 24:
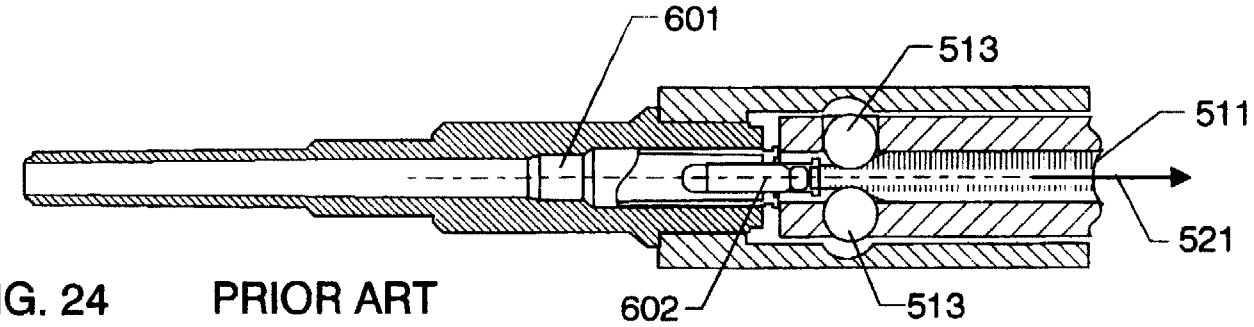
FIG. 24 PRIOR ART
FIG. 24 is a cross-sectional view showing the prior art locking mechanism with the inner cartridge driving the firing pin aft to allow unlocking.
Figure 25:
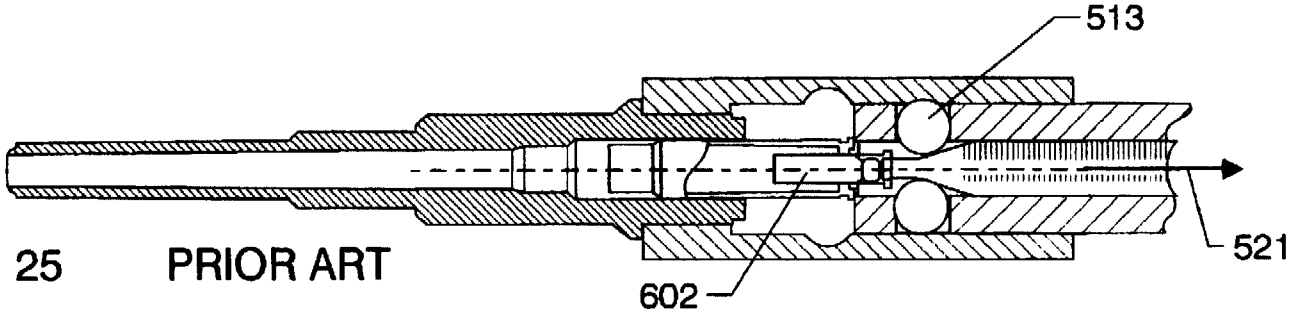
FIG. 25 PRIOR ART
FIG. 25 is a cross-sectional view showing the prior art locking mechanism with the cartridge extracted and ready for ejecting.

Referring now to FIGS. 23 through 25, operation of a bolt mechanism for a rocket launcher spotter rifle currently in use with the U.S. Armed Forces can be seen. The spotter cartridge 601 is a reduced-propellant cartridge modified to provide matching ballistics to a particular shoulder-launched weapon. The reduced propellant charge requires an inner cartridge 602 which contains the primer and reduced propellant charge. The cartridge 601 is shown in the firing position in a spotter rifle barrel 31 for reference.

With the bolt in the forward or firing position, as shown in FIG. 23, the firing pin 611 rests against the inner cartridge 602. The bolt locks 513 are locked by the position of the firing pin 511 holding the balls in detents in the bolt housing.

After firing, as shown in FIG. 24, the smaller inner cartridge 602 is driven backward by gas pressure and slides out of the main cartridge 601, thereby pushing the firing pin 511 rearward as depicted by arrow 521. The rearward movement of the firing pin 511 allows the bolt locks 513 to drop out of the detents unlocking the bolt.

Thereafter, as shown in FIG. 25, the entire bolt assembly slides rearward, as depicted by arrow 521, allowing ejection of the spent cartridge.

Figure 26:
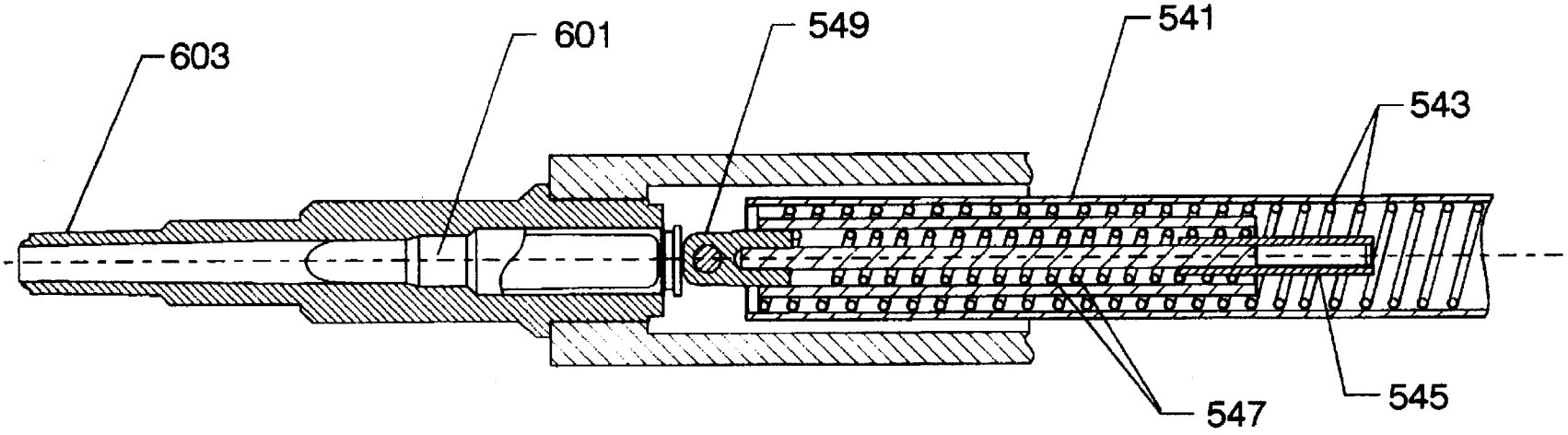
FIG. 26 is a cross-sectional view showing the bolt of the present invention in the firing position.

The present invention, as depicted in FIG. 26, has no ball locks to hold the bolt in position. The bolt and lock assembly comprises a two-part bolt assembly having a bolt housing 541 having a hollow cylindrical shape. The bolt housing 541 contains a first spring 543 which operates the bolt in conjunction with the gas operation. The cartridge 601 (a conventional single cartridge in this illustration) is shown chambered in the barrel 531 for reference. The weighting of the firing pin 549 provides an inertial resistance to movement which holds .the cartridge 601 in position for proper discharge. The firing pin 549 is urged in the forward direction by a second spring which serves as both a firing pin spring and as an initial absorber spring to decrease the impact acceleration of the bolt.

Figure 27:
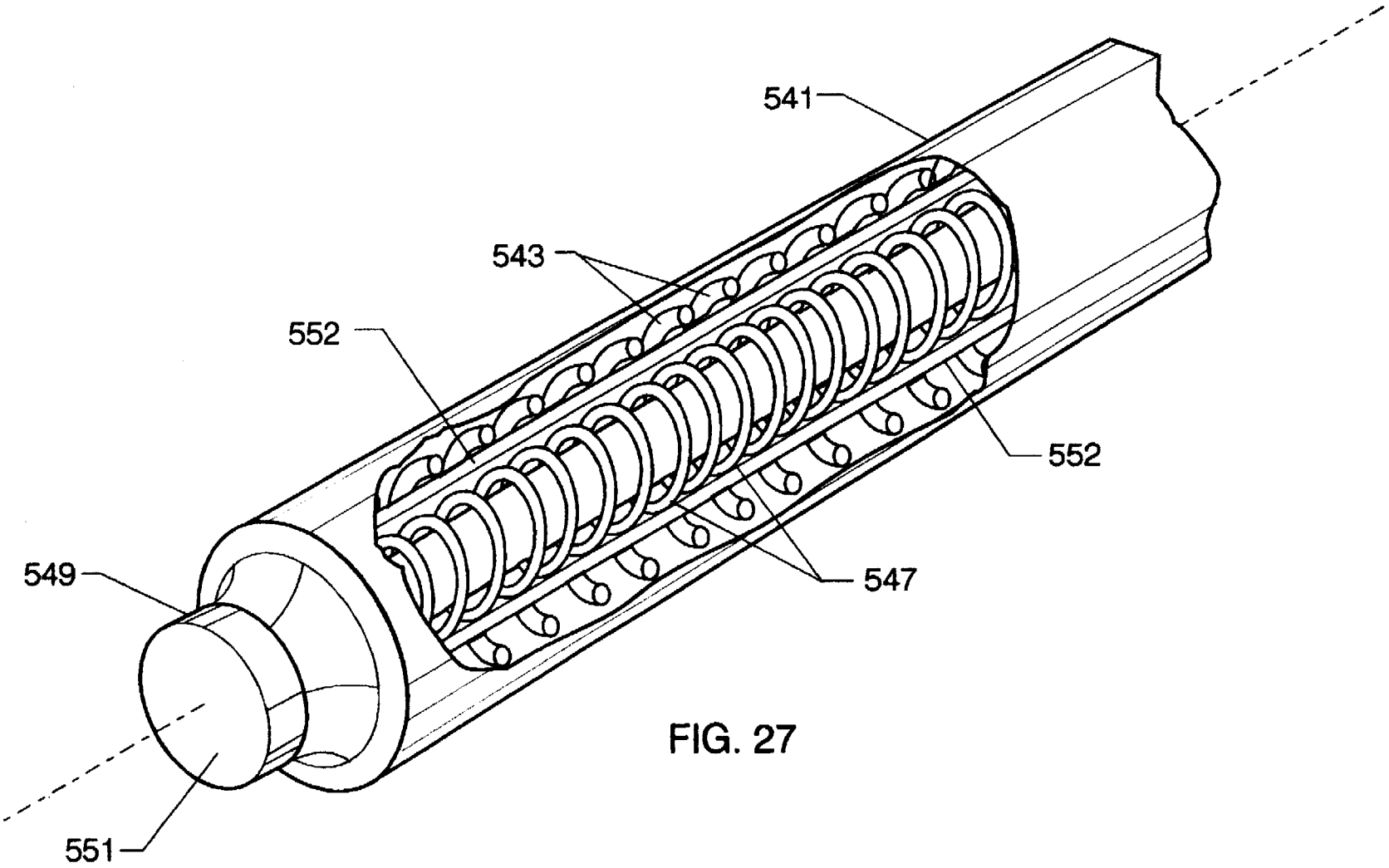
FIG. 27 is a perspective view of the breech bolt and lock assembly with a cutaway showing interior details.

The details of the bolt construction may be seen by reference to FIG. 27. The bolt housing 541 contains the bolt operating spring 543 which urges the bolt and firing pin assembly toward the forward or firing position (to the left as depicted). The outer cylindrical bolt 552 is slideably positioned within the bolt housing 541 and engages the spring 543 using a collar on the firing pin or left end. The firing pin 549 has a small pointed center 551 which aids in igniting the cartridge primer. The firing pin 549 is attached to a smaller shaft forming a pin and inner bolt mechanism which slideably engages the outer cylindrical bolt. The second spring 547 provides the dual function of driving the firing pin 549 toward the firing position and absorbing the initial impact of the discharging cartridge.

Figure 28:
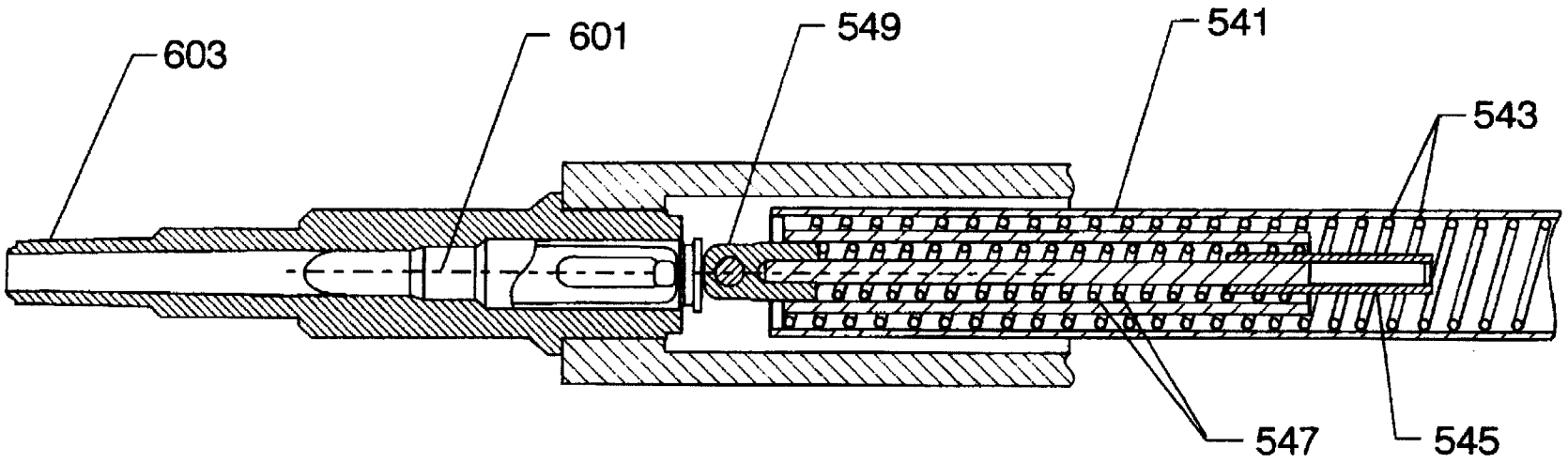
FIG. 28 is a cross-sectional view showing the breech bolt and lock assembly with a typical dual cartridge round.

Referring now to FIG. 28, the breech bolt and lock assembly is shown using the modified dual cartridge (required by spotter rifles in current use). The cartridge 601 is shown in firing position in the barrel 531. The firing pin 549 is in place ready to discharge the cartridge. The housing 541 and spring 543 and 547 are shown for reference. As can be appreciated, either type of cartridge may be fired using the new bolt and lock assembly. Although the more expensive and complex dual cartridge is not required, existing stocks will operate the new bolt.

Figure 29:
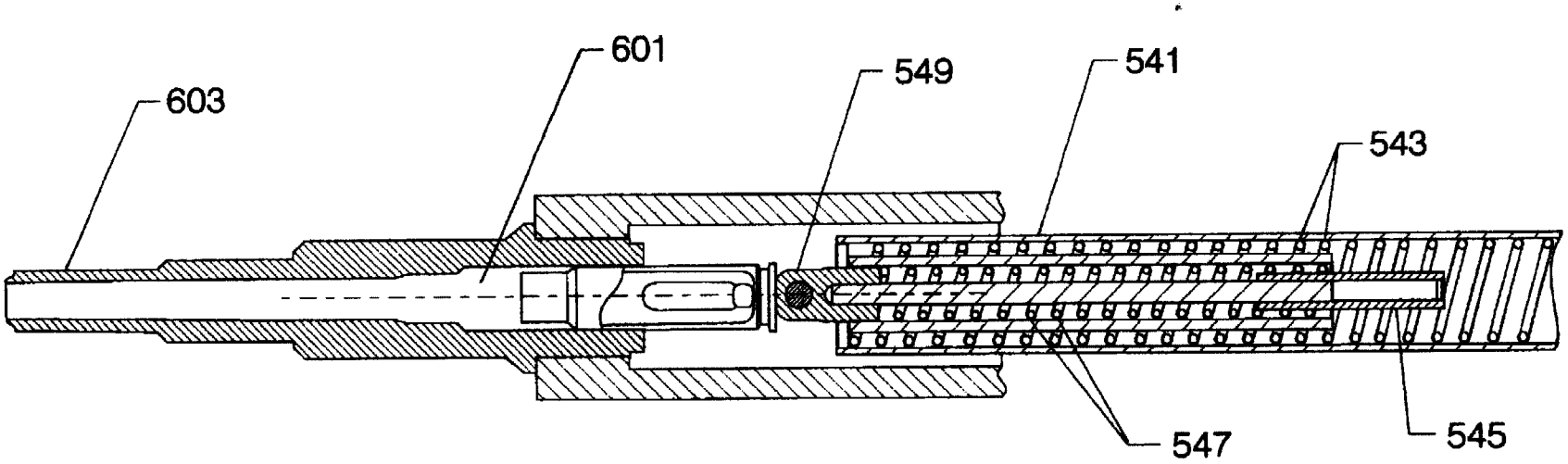
FIG. 29 is a cross-sectional view showing the extraction of a typical dual cartridge round.

Referring now to FIG. 29, the breech bolt and lock assembly is shown during extraction of a spent cartridge using the dual cartridge style round. In this case, the smaller inner cartridge remains in place in the larger cartridge 601 as it leaves barrel 531. Both cartridges acting together drive firing pin 549 rearward and thereafter drive the remaining bolt components rearward compressing springs 543 and 547.

Figure 30:
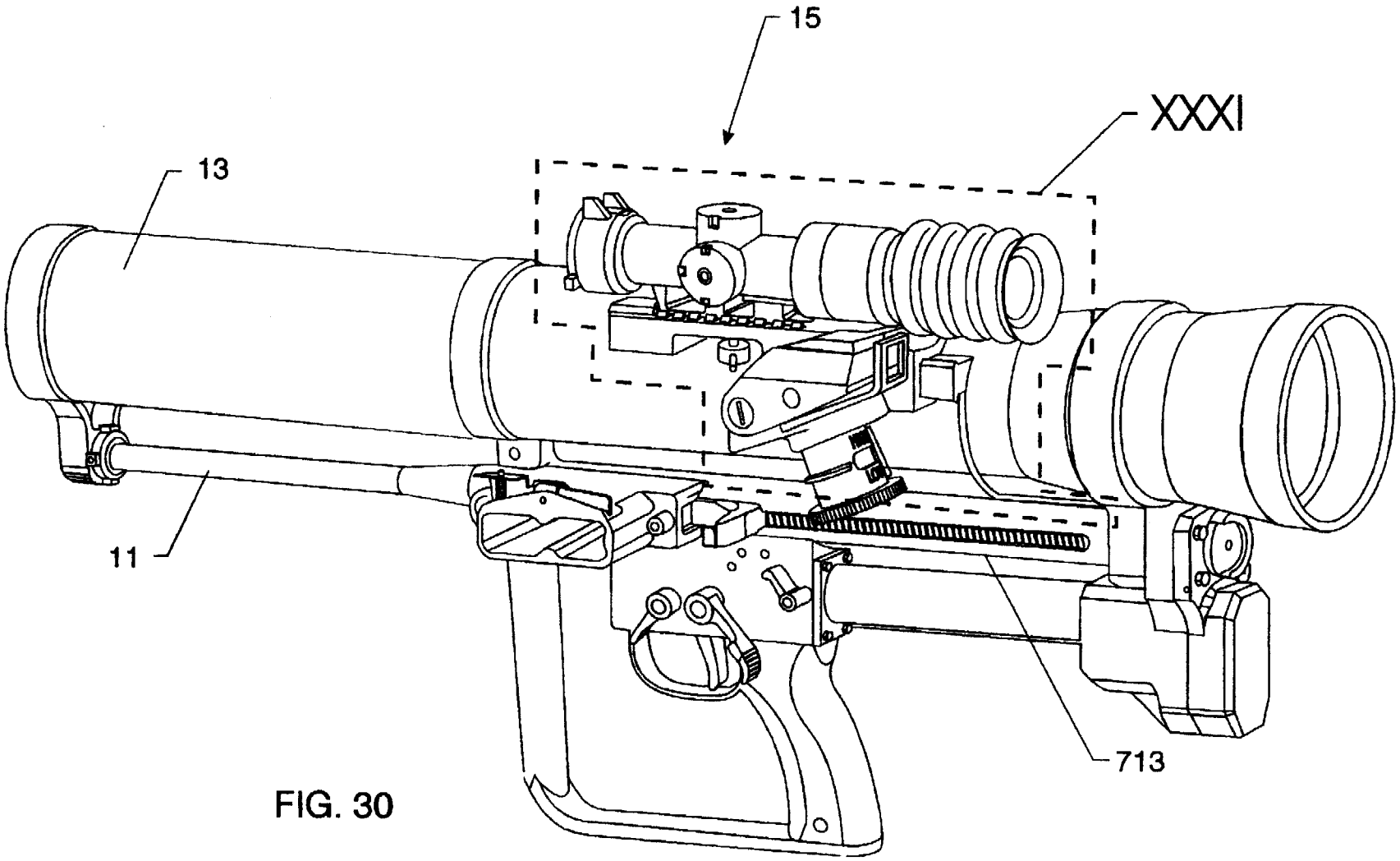
FIG. 30 is an overall view of the combination optical and open sight system shown mounted on a typical rocket launcher/spotter rifle assembly.

Referring now to FIG. 30, the overall combination optical and iron sight system of the present invention, designated generally by the reference numeral 10, is shown attached to a typical rocket launcher. The rocket launcher tube 13 is shown along with the spotter rifle 11 for reference. The sight system 15 is mounted on the receiver 713 of the spotter rifle 11 and is enclosed in the dotted box designated II, as shown further in FIG. 2.

Figure 31:
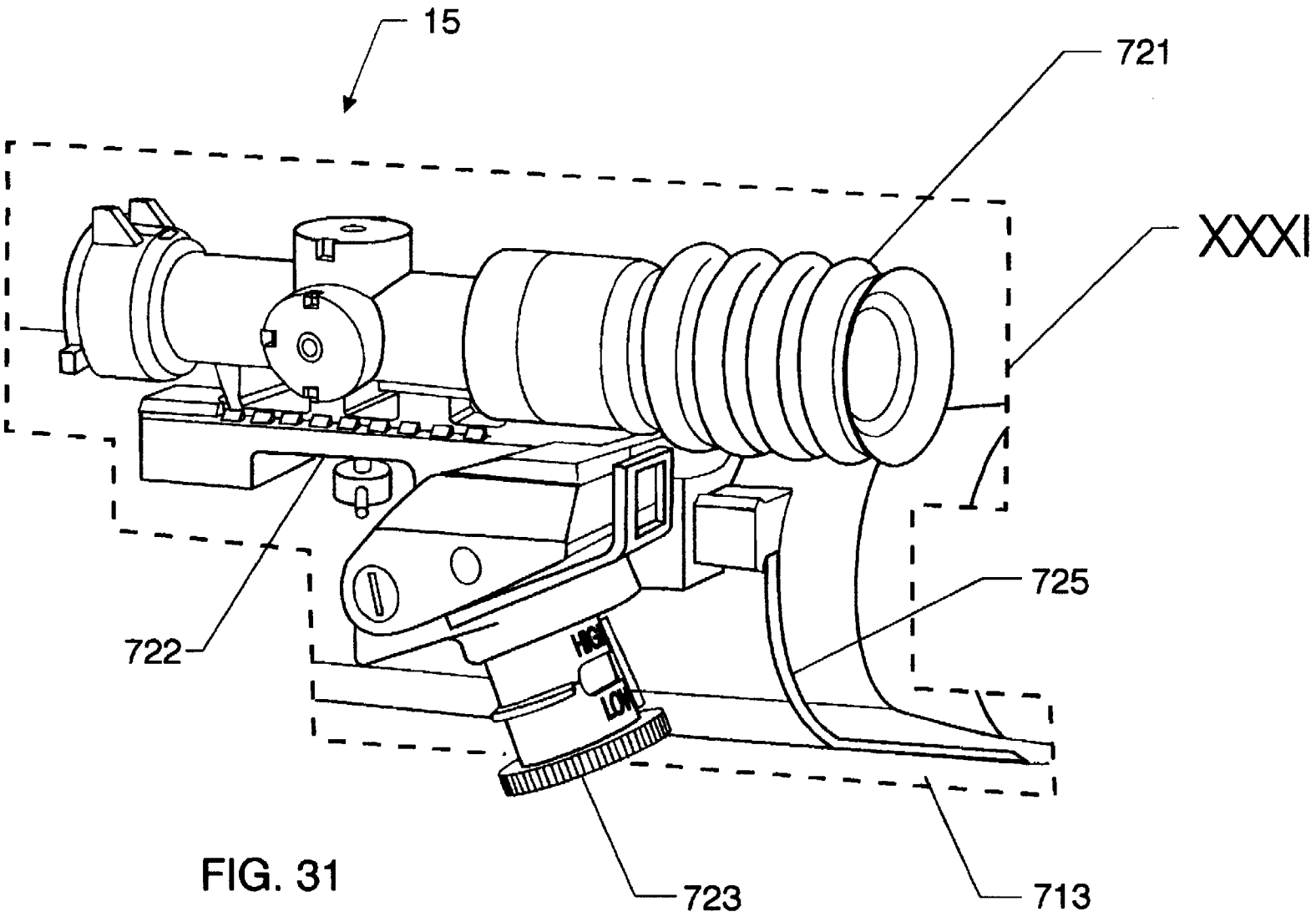
FIG. 31 is an overall view of the combination sight system showing the major components thereof.

Referring now to FIG. 31, major components of the combination optical and iron sight system 15 are shown. The optical scope 721 is attached to the adjustable sight mounting bracket 722 which, in turn, is attached to a rifle bracket mount 725 which attaches to the spotter rifle receiver 713. As the mounting for the optical scope is itself adjustable, the scope may be either adjustable or non-adjustable. The rifle bracket mount 725 is a cylindrical section which fits around a rocket tube. The elevation adjustment is achieved by adjustment knob 723. Not shown in this figure are the adjustable iron sights which are located on the right side of the optical scope 721, behind the scope in this view.

Figure 32:
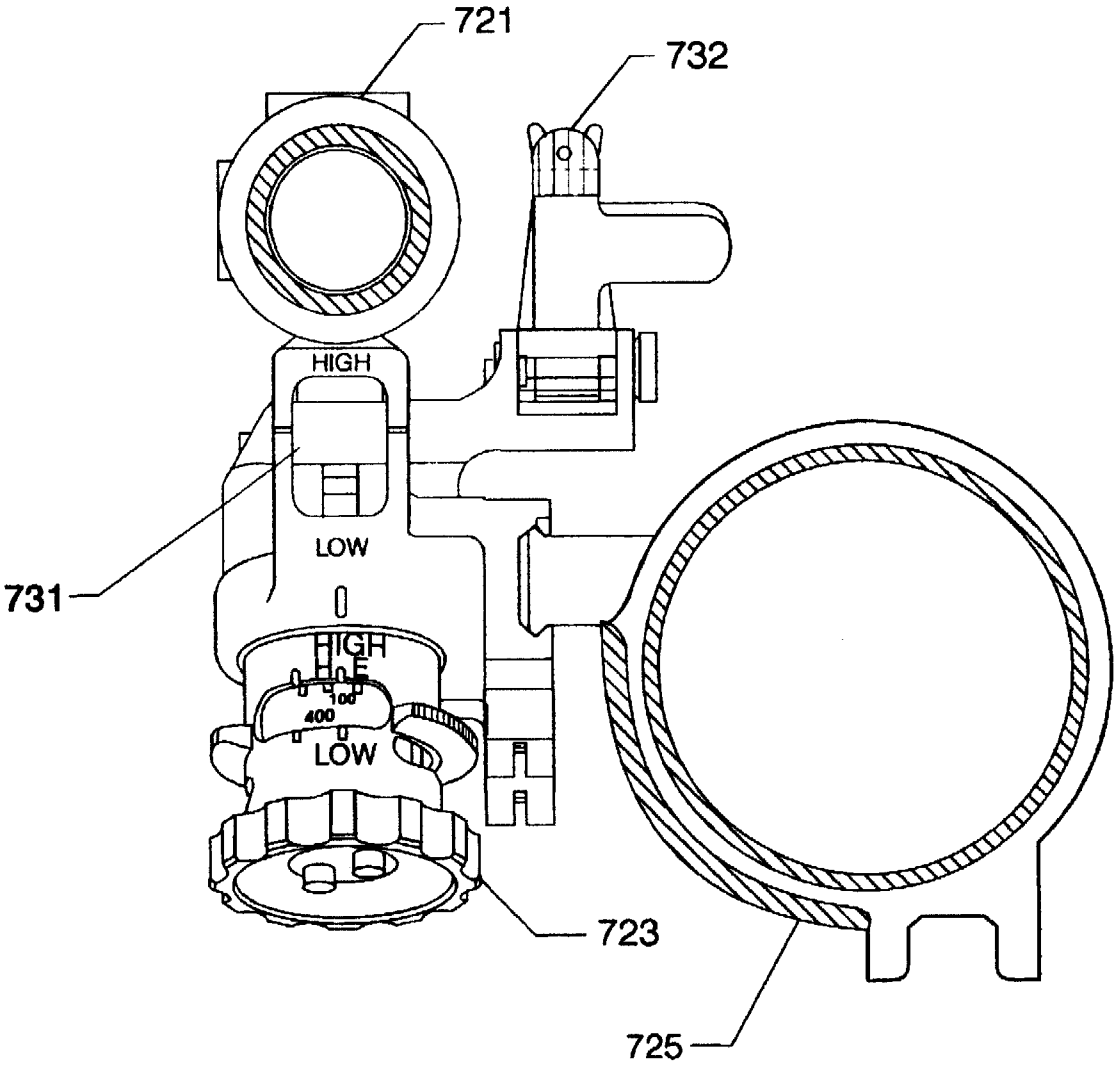
FIG. 32 is a rear view of the combination sight system.

A rear portion of the iron sight may be seen more clearly in FIG. 32 wherein the peep sight 732 is shown on the right side of optical sight 721. Alternatively, a rear notch sight may be used in place of peep sight 732. Mounting bracket 725 and elevation adjustment 723 are shown for reference. Also shown is the elevation adjustment window 731 which shows the general adjustment for range.

Figure 33:
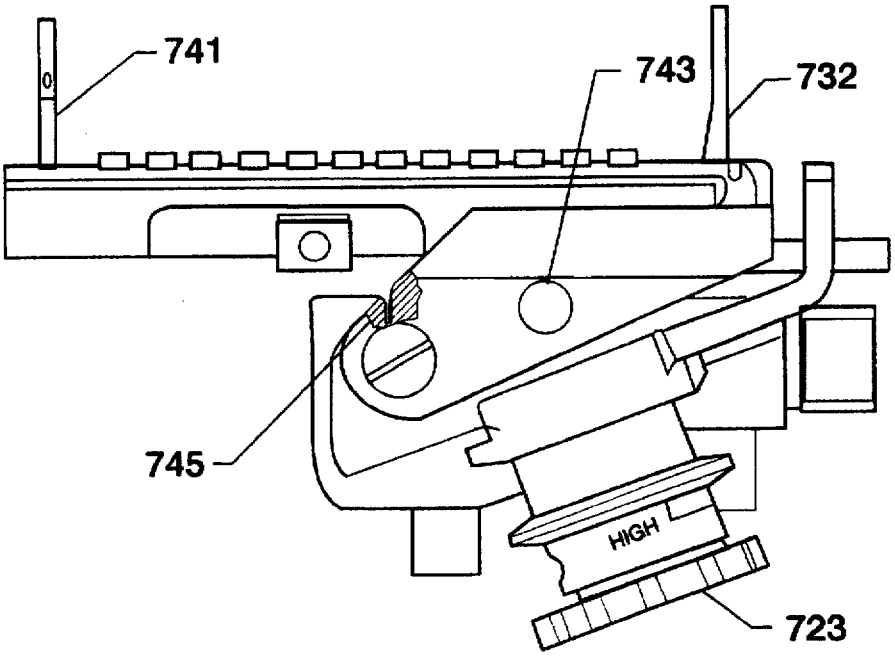
FIG. 33 is a side view of the adjustable sight mounting bracket.

Operation of the mounting bracket for both the optical scope and the iron sights may be seen more clearly in FIGS.32 and 33. In FIG. 33, the scope 721 has been removed and the iron sight can be seen: peep sight 732 and front post 741. Both the peep sight 732 and the front post 741 can be folded down into a stowed position so as to avoid damage during transport. The windage adjustment screw 745 adjusts the left and right angular positioning of the bracket and therefore adjusts both the optical and fixed sights. Likewise, the elevation adjustment 723 adjusts both the iron sights and the optical sight mounted on this bracket. A pin 743 accepts the load of the elevation adjustment 723 and pivots the entire bracket around screw 745.

Figure 34:
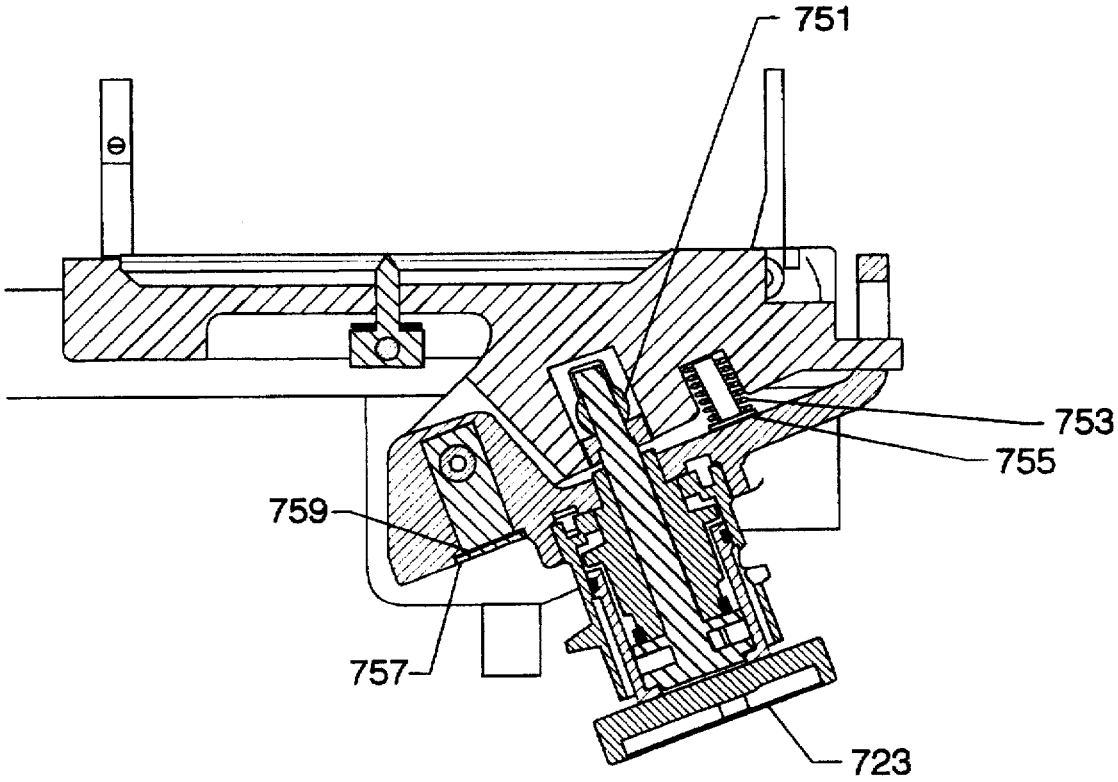
FIG. 34 is a cross-sectional view of the adjustable sight mounting bracket.

Referring now to FIG. 34, a cross-section of the bracket assembly as shown in FIG. 32 is depicted. The bracket assembly comprises a trunion pin 751, a tubular seal 752 sealing the mechanism against outside contaminants, a larger helical compression spring 753, and a smaller helical compression spring 755. Elevation adjustment knob 723 is shown again for reference. The windage adjustment comprises a steel shim 759 and a spring washer 757.

The benefits and novel features of the invention are numerous. A single trigger operates two separate hammer types necessary for firing either the spotter rifle or the main launcher tube. Selection between the weapons firing is accomplished by a simple depressible thumb selector. The mechanism allows repeated firing of the spotting rifle, but precludes further firing after the main munition is expended (until reloading the main munition). The spotting round barrel axis can be quickly and easily aligned with the launcher tube and can achieve a high level of precision in the alignment. Neither a firing of the spotting rifle or the rocket tube, nor a changing in heat or temperature of any part alter the alignment. Any longitudinal expansion is compensated for by compression of the spring retainer in the conical gripping collar. The split conical gripping collar compensates for any cross-sectional expansion of the barrel. All of these movements or expansions can take place while maintaining a precise alignment. Additionally, the common radiused surfaces on either end of the barrel allow the barrel to be rotated through a small arc necessary to make the adjustments while maintaining a perfect mate with the receiver. The combination pin provides a dual function, both safing the trigger assembly and securing it to the weapon traditionally, the single operating spring performs a dual function, both engaging the position detent and operating the ball lock mechanism. Further, removal of the pin automatically safes the trigger assembly, thereby preventing inadvertent firing during assembly or disassembly of the weapon. The dual functions serve to reduce the number and cost of parts, simplify the design, and improve reliability. The combination bolt lockback and cartridge ejector mechanism provides a simple mechanical device which has a high degree of reliability under extreme adverse conditions of dirt, dust, mud and water contamination. The single operating spring performs both the functions of operating the lock and the ejector. The reduced part count increases reliability, decreases weight, and reduces the cost of the weapon. The breech bolt and locking mechanism has a reduced parts count, has fewer operating parts, has no engaging locking device and as a result is less expensive and more reliable. Further, the new bolt and lock assembly can operate with any type of cartridge. There is no requirement for the expensive dual cartridge design currently in use. The invention allows the gunner (of a weapon to which this invention is attached) to quickly switch from an iron sight with a large field of view to a high-powered optical sight with a confined field of view without loss of weapon aim. It also allows the gunner to switch instantly to the iron sight in the event of optical sight failure such as sight fogging. Further, the dual mounting structure of the adjustable sight mounting bracket provides a first and second mounting structure which allow both the iron sight and the optical sight to be boresighted at a particular range and thereafter to have a single adjustment point to adjust both the optical sight and the iron sight for either elevation or windage. Additionally, the adjustable sight mounting bracket allows the use of a less expensive non-adjustable optical scope as the adjustable bracket itself can provide alignment of the scope. Thereafter, the iron sights can be aligned using the iron sight adjustments. Further adjustment for both sights can then be made as described for target range or windage changes.

Although the invention has been described relative to a specific embodiment thereof, there are numerous variations and modifications that will be readily apparent to those skilled in the art in the light of the above teachings. It is therefore to be understood that, within the scope of the appended claims, the invention may be practiced other than as specifically described.

What is claimed as new and desired to be secured by Letters Patent of the United States is:

1. A shoulder-launched multi-purpose assault weapon comprising:

a spotter rifle assembly comprising a spotting round bore alignment mechanism and dual-function subassemblies for assembling and safing, for cartridge ejecting and bolt locking back, and a dual spring breech bolt and lock assembly;

a detachable rocket tube mounted on the top of said spotter rifle assembly;

a combination adjustable optical and open sight system attached to said detachable tube;

a single trigger dual firing mechanism further comprising:

a trigger housing adapted for attachment to the spotter rifle;

a trigger rotatably mounted within said housing;

means for alternately operating said primary and secondary sears comprising a connector link rotatably mounted on said single trigger and having a first end with a first engaging lug and a second end with a second engaging lug;

a primary sear prop rotatably attached to said trigger housing and engaging the first end of said connector link;

a primary sear pivotally attached to said trigger housing and engaging said primary sear prop;

a primary hammer rotatably connected to said trigger housing and engaging said primary sear;

a primary hammer spring connected to said hammer on a first end and having a second end for connection to a connector link spring lever;

a spring lever engaging and operated by said primary hammer spring and further engaging said connector link thereby providing a downward impetus to the second end of said connector link and urging said link against said means for alternately operating said primary and secondary sears;

a secondary sear prop rotatably attached to said trigger housing and engaging the second end of said connector link;

a secondary sear rotatably mounted outside said trigger housing and engaging said secondary sear prop; and a secondary hammer slidably mounted outside said trigger housing and engaging said secondary sear.

2. A shoulder-launched multi-purpose assault weapon as in claim 1 wherein said means for alternately operating the primary and secondary sears further comprise a selector bar rotatably mounted to said trigger housing, said selector bar having a cam section for engaging the connector link.

3. A shoulder-launched multi-purpose assault weapon as in claim 2 wherein said means for alternately operating the primary and secondary sears further comprises a spring lever rotatably mounted on said means for housing and urging the second end of said connector link in a downward direction towards said selector bar.

4. A shoulder-launched multi-purpose assault weapon as in claim 3 wherein said spring lever engages and is operated by said primary hammer spring.

5. A shoulder-launched multi-purpose assault weapon as in claim 1 wherein said dual-function subassembly for assembling and safing is a combination pin comprising:

a handle;

a single means, attached to said handle, for attaching and safing a trigger assembly; and means for securing and releasing said combination pin.

6. A shoulder-launched multi-purpose assault weapon as in claim 5 wherein said single means comprises a retainer pin and cam assembly.

7. A shoulder-launched multi-purpose assault weapon as in claim 6 wherein said retainer pin and cam assembly further comprises a single piece housing having an insertion end and a handle end and having a smaller center bore at the insertion end and a larger center bore at the handle end and having transverse slots through the pin.

8. A shoulder-launched multi-purpose assault weapon as in claim 7 wherein said retainer pin and cam assembly further comprise a detent engagement mechanism slideably located within said retainer pin and cam assembly.

9. A shoulder-launched multi-purpose assault weapon as in claim 8 wherein said retainer pin and cam assembly further comprises a dual-action spring urging said detent engagement mechanism toward the insertion end of said retainer pin and cam assembly.

10. A shoulder-launched multi-purpose assault weapon as in claim 9 wherein said retainer pin and cam assembly further comprises a locking rod slideably located in the center bore of said pin.

11. A shoulder-launched multi-purpose assault weapon comprising:

a spotter rifle assembly comprising a spotting round bore alignment mechanism and dual-function subassemblies for assembling and safing, for cartridge ejecting and bolt locking back, and a dual spring breech bolt and lock assembly;

a detachable rocket tube mounted on the top of said spotter rifle assembly;

a combination adjustable optical and open sight system attached to said detachable tube;

a trigger assembly having a single trigger dual firing mechanism attached to said spotter rifle assembly;

means for selectively operating a first hammer and a second hammer connected to said trigger assembly; and means for locking out further trigger operation after operating said second hammer.

12. A shoulder-launched multi-purpose assault weapon comprising:

a fixed receiver for a spotting rifle adapted to serve as a mounting base;

a trigger housing attached to said fixed receiver;

a trigger housing frame adapted for attachment to the spotter rifle;

a trigger rotatably mounted within said housing;

a connector link pivotally mounted to said trigger, said trigger having a first lug at a first end for engagement of a primary sear and a second lug at a second end for engagement of a secondary sear;

a selector bar rotatably mounted on said housing frame and engaging said connector link with an eccentric cam section thereby providing a position central of said connector link;

a primary sear pivotally attached to said trigger housing frame and engaging said connector link;

a primary hammer rotatably connected to said trigger housing frame and engaging said primary sear;

a primary hammer spring connected to said hammer on a first end and having a second end for connection to a connector link spring lever;

a spring lever engaging and operated by said primary hammer spring and further engaging said connector link thereby providing a downward impetus to the second end of said connector link and urging said link against the selector bar;

a secondary sear prop rotatably attached to said trigger housing frame and engaging the second end of said connector link;

a secondary sear rotatably mounted outside said housing frame and engaging said sear prop;

a secondary hammer slidably mounted outside said housing and engaging said secondary sear;

an adjustable spotting rifle barrel having a muzzle end and a breech end, said breech end having a spherical mating surface for mating with said fixed receiver and said muzzle end having a second spherical mating surface;

a receiver ring bracket assembly for attaching a spotting rifle receiver to a rocket launcher tube, said receiver having a concave conical surface for mating with a spotting rifle barrel;

a barrel retaining pin attached to said receiver and ring bracket and further securing said spotting rifle barrel to said receiver;

a muzzle ring bracket assembly for attaching the muzzle of the spotter rifle barrel supports to a rocket launcher tube;

a locating washer, grip collar and spring assembly mating said spotter rifle muzzle shoulders and engaging said locating washer having a spherical surface for engagement of said muzzle ring bracket assembly;

adjustment screws threaded through said muzzle bracket assembly and providing an adjustment to align the spotter rifle barrel axis with the rocket launcher tube;

a retainer pin and cam assembly, insertably attached to said trigger housing and to said receiver frame, having an insertion end and a handle end and having a smaller center bore on the insertion end and a larger center bore on the handle end;

a plurality of locking balls located in apertures on said retainer pin and cam assembly;

a locking rod having an insertion end and a handle end inserted into the center bore of said retainer pin and cam assembly.

a washer attached to said locking rod near the handle end of said rod;

a detent engagement mechanism slideably engaging said locking rod;

a dual-action spring installed over said locking rod and further located with the larger center bore section of said retainer pin and cam assembly;

a handle affixed to said retainer pin and cam assembly;

a spring pin located in said handle and securing said handle to said retainer pin and cam assembly;

a hollow cylindrical bolt lockback inserted through said trigger housing and having an upper slot and a lower slot and having beveled shoulders on a bolt-engaging end;

an operating spring inserted inside said hollow cylindrical bolt lockback;

a cartridge ejector having a slot and being inserted into said hollow cylindrical bolt lockback and thereby compressing said operating spring;

a retainer spring inserted through the slots of both said bolt lockback and said cartridge ejector;

a bolt housing attached to said fixed receiver having a cylindrical shape;

a first spring contained within said bolt housing;

a two-part bolt assembly having an outer cylindrical bolt slideably positioned within said bolt housing and operated by said first spring and having an inner bolt and pin mechanism slideably positioned within said outer cylindrical bolt; and a second spring positioned within said outer cylindrical bolt and enclosing said inner bolt and pin assembly and further urging said inner bolt and pin assembly toward the firing position.

* * * * *